US009820529B2

(12) United States Patent
Droege et al.

(10) Patent No.: US 9,820,529 B2
(45) Date of Patent: Nov. 21, 2017

(54) ASYMMETRIC TORSION PLATE AND COMPOSITE SOLE STRUCTURE FOR ARTICLE OF FOOTWEAR

(71) Applicant: NIKE, Inc., Beaverton, OR (US)

(72) Inventors: John Droege, Portland, OR (US); Jeongwoo Lee, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/627,269

(22) Filed: Feb. 20, 2015

(65) Prior Publication Data

US 2016/0242499 A1 Aug. 25, 2016

(51) Int. Cl.

| | |
|---|---|
| ***A43B 13/12*** | (2006.01) |
| ***A43B 13/02*** | (2006.01) |
| ***A43B 13/42*** | (2006.01) |
| ***A43C 15/16*** | (2006.01) |
| ***A43B 13/18*** | (2006.01) |

(52) U.S. Cl.

CPC ..... *A43B 13/12* (2013.01); *A43B 13/026* (2013.01); *A43B 13/181* (2013.01); *A43B 13/42* (2013.01); *A43C 15/16* (2013.01)

(58) Field of Classification Search

CPC ..... A43B 13/12; A43B 13/16; A43B 13/026; A43B 13/127; A43B 13/141; A43B 1/0009; A43B 3/0073

USPC ..... 36/108, 76 R

See application file for complete search history.

(56) References Cited

U.S. PATENT DOCUMENTS

| | | | | |
|---|---|---|---|---|
| 4,858,343 | A | 8/1989 | Flemming | |
| 5,003,709 | A | 4/1991 | Okayasu et al. | |
| D331,491 | S | 12/1992 | Ohno | |
| 5,461,801 | A * | 10/1995 | Anderton | A43B 3/0052 24/713.4 |

(Continued)

FOREIGN PATENT DOCUMENTS

| | | | |
|---|---|---|---|
| EP | 0752216 | A2 | 1/1997 |
| EP | 1728446 | A1 | 12/2006 |
| WO | 2016133816 | A1 | 8/2016 |

OTHER PUBLICATIONS

International Search Report and Written Opinion for Application No. PCT/US2016/017757, mailed on Jun. 1, 2016, 10 pages.

*Primary Examiner* — Megan Brandon

(74) *Attorney, Agent, or Firm* — Honigman Miller Schwartz and Cohn LLP; Matthew H. Szalach; Jonathan P. O'Brien

(57) ABSTRACT

A composite sole structure for an article of footwear includes a bottom component and an intermediate component. Each of the intermediate component and the bottom component includes a protruding portion that forms a concave contour on the top surface and a corresponding convex contour on the bottom surface of the component, where the protruding portion includes at least a first portion that forms a continuous trough at least from a medial side of the forefoot region, e.g., from a medial side of a toe split, to a lateral side of the heel region, e.g., a heel strike region. The bottom component further includes a variable thickness profile that forms a continuous ridge on the bottom surface, the ridge extending from the medial side of the forefoot region to the lateral side of the heel region, the ridge being substantially aligned with the first portion of the protruding portion of the intermediate component and the bottom component.

18 Claims, 13 Drawing Sheets

(56) References Cited

U.S. PATENT DOCUMENTS 5,555,650 A 9/1996 Longbottom et al.
D378,319 S 3/1997 Miyauchi
5,625,965 A 5/1997 Blissett et al.
5,694,706 A 12/1997 Penka
D389,298 S 1/1998 Briant
6,016,613 A 1/2000 Campbell et al.
D461,297 S 8/2002 Lancon
7,437,838 B2 * 10/2008 Nau ..... A43B 3/0036 36/102
7,441,350 B2 10/2008 Auger et al.
7,832,119 B2 11/2010 Gilmore
8,082,684 B2 12/2011 Munns
8,209,883 B2 7/2012 Lyden et al.
8,356,428 B2 * 1/2013 Auger ..... A43B 5/02 36/102
8,387,279 B2 * 3/2013 Pauk ..... A43B 13/12 36/25 R
2002/0005000 A1 1/2002 Choi
2004/0055180 A1 * 3/2004 Manz ..... A43B 3/0036 36/25 R
2005/0268490 A1 * 12/2005 Foxen ..... A43B 7/1425 36/28
2007/0169376 A1 * 7/2007 Hatfield ..... A43B 7/1415 36/29
2008/0010863 A1 * 1/2008 Auger ..... A43B 13/026 36/107
2008/0052965 A1 3/2008 Sato
2008/0127523 A1 6/2008 Hauglin
2010/0126044 A1 * 5/2010 Davis ..... A43B 1/0009 36/108
2010/0293816 A1 * 11/2010 Truelsen ..... A43B 5/06 36/30 R
2011/0030245 A1 * 2/2011 Truelsen ..... A43B 5/06 36/30 R
2011/0088287 A1 * 4/2011 Auger ..... A43B 5/02 36/107
2011/0107622 A1 * 5/2011 Schwirian ..... A43B 5/14 36/30 A
2011/0185590 A1 * 8/2011 Nishiwaki ..... A43B 5/06 36/28
2012/0036740 A1 * 2/2012 Gerber ..... A43B 5/02 36/134
2012/0180343 A1 * 7/2012 Auger ..... A43B 5/02 36/30 R
2012/0204449 A1 8/2012 Stockbridge et al.
2012/0272548 A1 11/2012 Downard
2013/0067765 A1 * 3/2013 Auger ..... A43B 5/02 36/31
2013/0139412 A1 * 6/2013 Auger ..... A43B 1/0009 36/25 R
2013/0318831 A1 * 12/2013 Foxen ..... A43B 5/02 36/25 R
2013/0340295 A1 * 12/2013 Adami ..... A43B 5/02 36/25 R
2014/0082969 A1 * 3/2014 Binzer ..... A43B 13/22 36/107
2014/0202031 A1 * 7/2014 Seo ..... A43B 13/127 36/28
2016/0021972 A1 * 1/2016 Grelle ..... A43B 3/0057 36/140

* cited by examiner

ASYMMETRIC TORSION PLATE AND COMPOSITE SOLE STRUCTURE FOR ARTICLE OF FOOTWEAR

FIELD OF THE INVENTION

The current embodiments relate to articles of footwear. More specifically, the current embodiments relate to a sole structure for articles of footwear.

BACKGROUND

Articles of athletic footwear typically include two elements, an upper and a sole structure. The upper may provide a covering for the foot that comfortably receives and securely positions the foot with respect to the sole structure. A sole structure may be secured to a lower portion of the upper and may be generally positioned between the foot and a ground surface or other surface. In addition to attenuating ground reaction forces (i.e., providing cushioning) during walking, running, and other ambulatory activities, a sole structure may facilitate control of foot motions (e.g., by resisting pronation), impart stability, facilitate control of twisting and/or bending motions, and provide traction, for example. Accordingly, a sole structure may cooperate with an upper to provide a comfortable structure that is suited for a wide variety of athletic or other activities.

BRIEF DESCRIPTION OF THE DRAWINGS

The current embodiments can be better understood with reference to the following drawings and description. Components in the figures are not necessarily drawn to scale, emphasis instead being placed upon illustrating principles of the current embodiments. In the figures, like reference numerals designate corresponding parts throughout the different views, and the initial digits of the reference numerals indicate the figure in which the reference numeral is first used.

DETAILED DESCRIPTION

Figure 1:
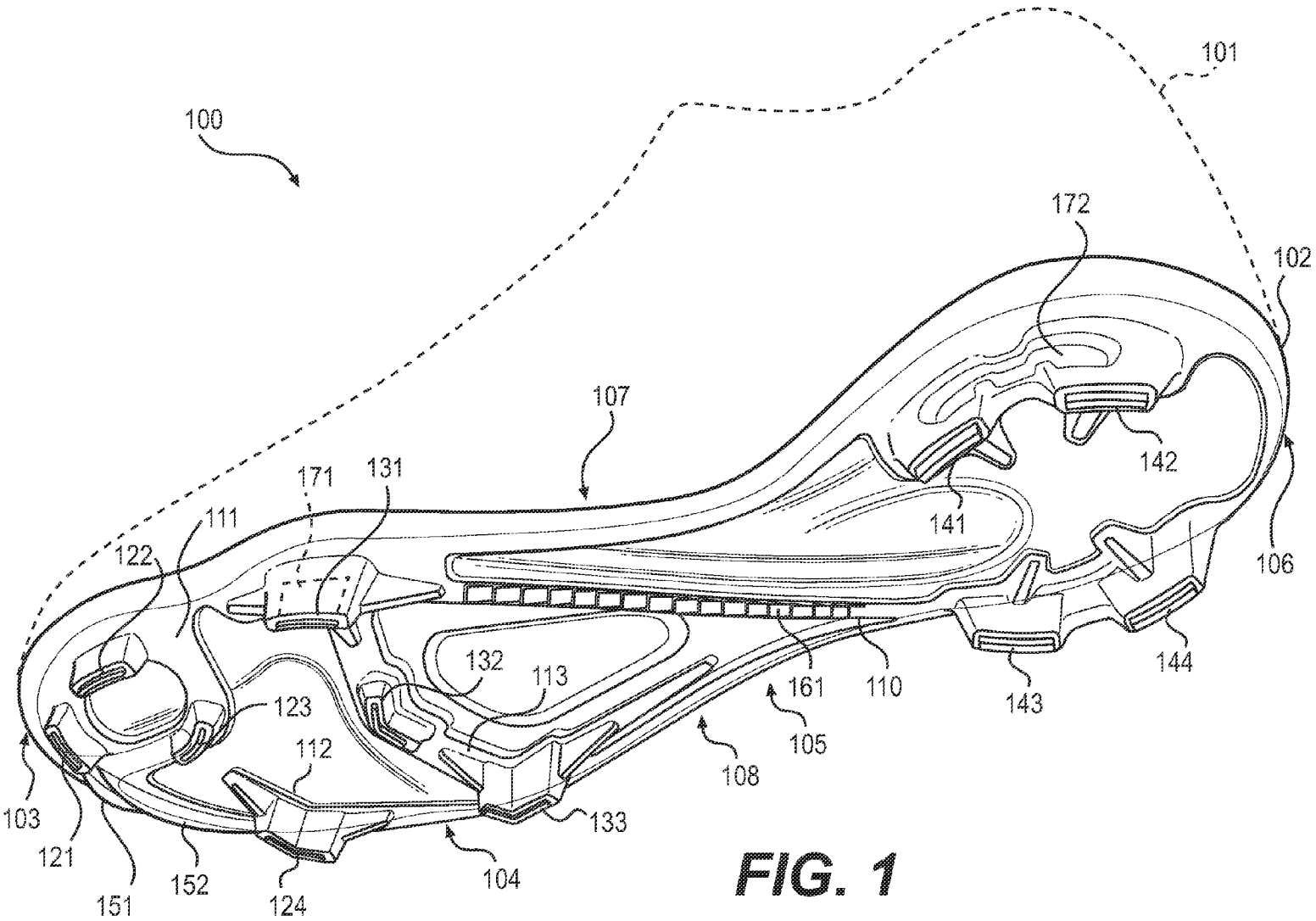
FIG. 1 is an isometric view of an embodiment of an article of footwear viewed from a bottom medial side.

In one aspect, an article of footwear may have a sole structure including a bottom component and an intermediate component. The sole structure may have a toe region, a forefoot region, a midfoot region, and a heel region. The sole structure may have a medial side and a lateral side. The intermediate component may have a top surface, a bottom surface, and a protruding portion that forms a concave contour on the top surface of the intermediate component and a corresponding convex contour on the bottom surface of the intermediate component. The protruding portion may include at least a first portion that forms a continuous trough at least from the medial side of the forefoot region through the midfoot region to the lateral side of the heel region. The bottom component may have a top surface, a bottom surface, and a protruding portion that forms a concave contour on the top surface of the bottom component and a corresponding convex contour on the bottom surface of the bottom component. The protruding portion may include at least a first portion that forms a continuous trough at least from the medial side of the forefoot region through the midfoot region to the lateral side of the heel region. The top surface of the bottom component may contact the bottom surface of the intermediate component. The first portion of the bottom component may be aligned with the first portion of the intermediate component, and the bottom surface of the bottom component may be configured to engage a ground surface. The bottom component may further have a variable thickness profile that forms a continuous ridge on the bottom surface of the bottom component. The ridge may extend from the medial side of the forefoot region through the midfoot region to the lateral side of the heel region. The ridge may be substantially aligned with the first portion of the intermediate component and the first portion of the bottom component.

The intermediate component may further include a slot forming a toe split that separates a first toe portion on the medial side of the toe region from a second toe portion on the lateral side of the toe region.

The protruding portion of the intermediate component may include a second portion located in the first toe portion of the intermediate component. The protruding portion of the bottom component may include a second portion located on the medial side of the toe region. The second portion of the bottom component may be substantially aligned with the second portion of the intermediate component.

The bottom component may further have a thickness profile that forms webbing on the bottom surface of the bottom component. The webbing may include a first web portion located around at least a portion of a periphery of the second portion of the bottom component. The first web portion may be disposed over at least a portion of the slot in the intermediate component.

The first web portion may have a width and thickness sufficient to control a rigidity characteristic of the intermediate component at the toe split.

The intermediate member may comprise a carbon fiber material.

The sole structure may further comprise an upper component. The upper component may have a top surface and a bottom surface. The bottom surface of the upper component may be disposed adjacent the top surface of the intermediate component.

The upper component may further comprise a protruding portion that forms a concave contour on the top surface of the upper component and a corresponding convex contour on the bottom surface of the upper component. The protruding portion of the upper component may include at least a first portion that forms a continuous trough at least from the medial side of the forefoot region through the midfoot region to a lateral side of the heel region. The first portion of the protruding portion of the upper component may be aligned with the first portion of the intermediate component.

The bottom surface of the upper component may be joined with the top surface of the intermediate component.

The sole structure may further comprise a chambered component disposed in at least the first portion of the intermediate component.

The sole structure may further comprise a chambered component disposed in the first portion of the upper component.

The sole structure may further comprise a chambered component disposed in the first portion of the intermediate component.

The protruding portion of the intermediate component may include a Y-shaped element in the midfoot region.

The protruding portion of the bottom component may include a Y-shaped element in the midfoot region that aligns with the Y-shaped element of the intermediate component.

The sole structure may further comprise a chambered component disposed in at least the first portion of the intermediate component. The chambered component may include a Y-shaped element in the midfoot region that aligns with the Y-shaped element of intermediate component.

The sole structure may further comprise an upper component. The upper component may have a top surface and a bottom surface. The upper component may further comprise a protruding portion that forms a concave contour on the top surface of the upper component and a corresponding convex contour on the bottom surface of the upper component. The bottom surface of the upper component may be disposed adjacent the top surface of the intermediate component. The protruding portion of the upper component may include a Y-shaped element in the midfoot region that aligns with the Y-shaped element of the intermediate component.

The sole structure may further comprise a chambered component disposed in at least the first portion of the upper component. The chambered component may include a Y-shaped element in the midfoot region that aligns with the Y-shaped element of the intermediate component.

The chambered component may include a first portion having a first volume density and a second portion having a second volume density different from the first volume density. The first volume density may be located at the forefoot region of the sole structure.

In one aspect, an article of footwear may have a sole structure including a sole plate formed of a carbon fiber material. The sole structure may have a toe region, a forefoot region, a midfoot region, and a heel region. The sole plate may have a top surface and a bottom surface. The sole plate may include a protruding portion that forms a concave contour on the top surface of the sole plate and a corresponding convex contour on the bottom surface of the sole plate. The protruding portion may include at least a first portion that forms a continuous trough at least from a medial side of the forefoot region through the midfoot region to a lateral side of the heel region.

The sole plate may further include a slot forming a toe split that separates a first toe portion at the medial side of the toe region from a second toe portion at the lateral side of the toe region. A second portion of the protruding portion of the sole plate may be located in the first toe portion.

In another aspect, a method of making a sole structure may include forming an intermediate component of a first material including carbon fibers. The intermediate component may have a top surface, a bottom surface, and a protruding portion that forms a concave contour on the top surface of the intermediate component and a corresponding convex contour on the bottom surface of the intermediate component. The protruding portion may include at least a first portion that forms a continuous trough at least from a medial side of a forefoot region through a midfoot region to a lateral side of a heel region of the intermediate component. The method may include forming a bottom component of a second material. The bottom component may have a top surface, an exposed bottom surface, and a protruding portion that forms a concave contour on the top surface of the bottom component and a corresponding convex contour on the bottom surface of the bottom component. The protruding portion of the bottom component may include at least a first portion that forms a continuous trough at least from a medial side of a forefoot region through a midfoot region to a lateral side of a heel region of the bottom component. The bottom component may further have a thickness profile that forms a continuous ridge on the bottom surface of the bottom component. The ridge may extend from the medial side of the forefoot region through the midfoot region to the lateral side of the heel region. The ridge may be substantially aligned with the first portion of the bottom component. The method may include joining the bottom surface of the intermediate component with the top surface of the bottom component so that the first portion of the bottom component is aligned with the first portion of the intermediate component.

The method may further include forming a chambered component and placing the chambered component in at least the first portion of the intermediate component.

The method may further include forming an upper component of a third material. The upper component may have a top surface, a bottom surface, and a protruding portion that forms a concave contour on the top surface of the upper component and a corresponding convex contour on the bottom surface of the upper component. The protruding portion may include at least a first portion that forms a continuous trough at least from a medial side of a forefoot region through a midfoot region to a lateral side of a heel region of the upper component. The method may further include joining the bottom surface of the upper component with the top surface of the intermediate component so that the first portion of the upper component is aligned with the first portion of the intermediate component and the first portion of the bottom component. The method may further include forming a chambered component and placing the chambered component in at least the first portion of the intermediate component.

The method may further include bonding the intermediate component to the bottom component using a heat pressing process.

Other systems, methods, features, and advantages of the current embodiments will be, or will become, apparent to one of ordinary skill in the art upon examination of the following figures and detailed description. It is intended that all such additional systems, methods, features, and advantages be included within this description, be within the scope of the current embodiments, and be protected by the following claims.

Embodiments of articles of footwear in this description have a sole structure including a sole plate with an engineered geometry for controlling torsional rigidity of the sole structure. The sole plate and sole structure generally have contoured surface and thickness profiles configured to provide a desired asymmetric torsional rigidity profile. The asymmetric torsional rigidity profile includes selected areas of relatively high or increased rigidity and/or selected areas of relatively high or increased flexibility. The asymmetrical torsional rigidity may facilitate natural movement of the foot during use of the article of footwear and provide improved performance characteristics of the article of footwear and the user.

Figure 2:
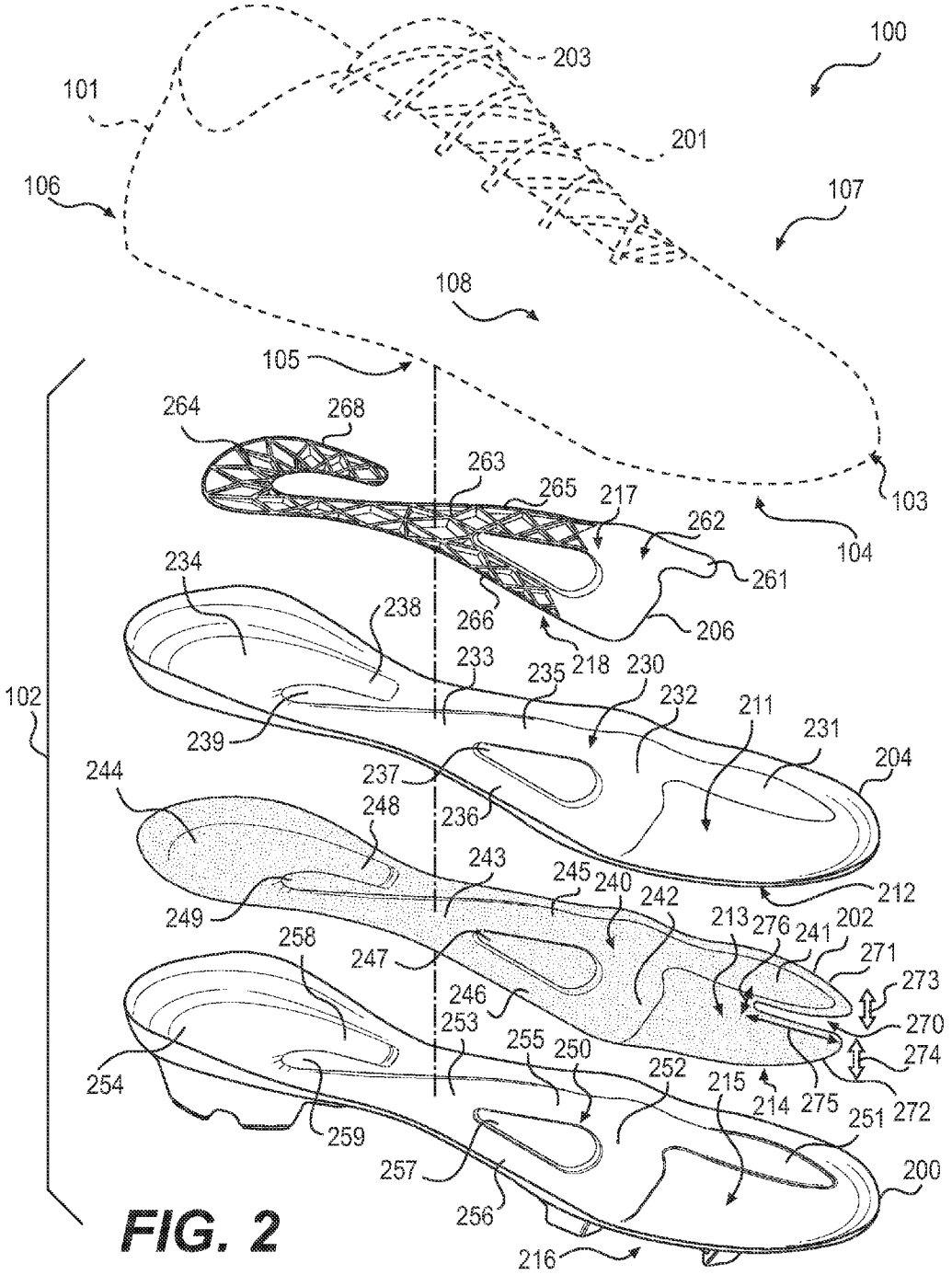
FIG. 2 is an exploded isometric view of the article of footwear of FIG. 1 viewed from a top lateral side.

FIGS. 1 and 2 illustrate an embodiment of an article of footwear 100. FIG. 1 is a perspective view of article of footwear 100 viewed from a bottom medial side. In some embodiments, article of footwear 100 generally includes an upper 101 (shown in dashed lines) and a sole structure 102. FIG. 2 illustrates an exploded isometric view of an embodiment of article of footwear 100 including upper 101 and sole structure 102.

The following discussion and accompanying figures disclose article of footwear 100 as having a general configuration suitable for soccer or football. Concepts associated with article of footwear 100 also may be applied to a variety of other athletic footwear types, including running shoes, baseball shoes, basketball shoes, cross-training shoes, cycling shoes, football shoes, golf shoes, tennis shoes, walking shoes, and hiking shoes and boots, for example. Concepts associated with article of footwear 100 also may be applied to footwear types that are generally considered to be non-athletic, including dress shoes, loafers, sandals, and work boots, for example. Accordingly, concepts associated with article of footwear 100 disclosed herein apply to a wide variety of footwear types.

The following discussion and accompanying figures disclose article of footwear 100 as having a sole structure 102 forming a plate (i.e., a sole plate or composite sole plate) that includes, for example, a bottom component, an intermediate component, an upper component, and a chambered component. Some embodiments may include additional components. For example, in some embodiments article of footwear 100 may include a midsole component or element (not shown) disposed between upper 101 and sole structure 102. In some embodiments a midsole element may be secured to a lower surface of upper 102 (e.g., by stitching, adhesive bonding, or thermal bonding). In some embodiments, one or more portion of a midsole element may be exposed around the periphery of sole structure 102. In some embodiments, a midsole element may be covered by another element, such as a material layer of upper 101. A midsole element may be formed from a foamed polymer material, such as polyurethane or ethylvinylacetate, and operate to attenuate ground reaction forces as sole structure 102 contacts and is compressed against a ground surface during walking, running, or other ambulatory activities. A lower area of a midsole element may define an area in which a portion of sole structure 102 may be located.

As shown in FIGS. 1 and 2, article of footwear 100 generally has a toe region 103, a forefoot region 104, a midfoot region 105, and a heel region 106. Toe region 103 may form a portion of forefoot region 104. Article of footwear 100 also generally has a medial side 107 and a lateral side 108. It will be understood that references to toe region 103, forefoot region 104, midfoot region 105, heel region 106, medial side 107, and lateral side 108 are only intended for purposes of description and are not intended to demarcate precise portions or regions of sole structure 102.

For consistency and convenience, directional adjectives are employed throughout this detailed description corresponding to the illustrated embodiments. The term "longitudinal" as used throughout this detailed description and in the claims refers to a direction extending a length of a component, such as a sole structure. In some cases, the longitudinal direction may extend from a forefoot portion to a heel portion of the component. The term "lateral" as used throughout this detailed description and in the claims refers to a direction extending a width of a component. In some cases, the lateral direction may extend between a medial side and a lateral side of the component, or along the width of the component. The terms longitudinal and lateral can be used with any component of an article of footwear, including a sole structure as well as individual components of the sole structure.

Sole structure 102 may be joined with upper 101 in various ways in different embodiments. As shown in FIGS. 1 and 2, upper 101 may be depicted as having a substantially conventional configuration incorporating a plurality of material elements (e.g., knit, woven, or other textiles, foam, leather, synthetic leather, and other materials) that are stitched or adhesively bonded together to form an interior void for securely and comfortably receiving a foot. The material elements may be selected and located with respect to upper 101 in order to selectively impart properties of durability, air-permeability, wear-resistance, flexibility, and comfort, for example. In some embodiments, an ankle opening may be provided in heel region 106 to provide access to the interior void. In some embodiments, upper 101 may include a lacing system 201 that may be utilized in a conventional manner to modify the dimensions of the interior void, thereby securing the foot within the interior void and facilitating entry and removal of the foot from the interior void. For example, in some embodiments lacing system 201 may include lacing that extends through apertures in upper 101, and a tongue portion 203 of upper 101 may extend between the interior void and lacing system 201. Because various aspects of the present discussion primarily relate to sole structure 102, it will be appreciated that upper 101 may exhibit the general configuration discussed above or the general configuration of practically any other conventional, non-conventional, or later developed upper suitable for a desired application. Accordingly, the overall structure of upper 101 may vary significantly in different embodiments.

In some embodiments, sole structure 102 may be secured to upper 101 and has a configuration that extends between upper 101 and a ground surface. In some embodiments, sole structure 102 may extend between upper 101 and another surface, such as a surface of a soccer ball or other ball. In addition to attenuating ground reaction forces (i.e., cushioning the foot), sole structure 102 may provide traction, impart stability, and facilitate or limit various foot motions, such as pronation.

Sole structure 102 generally may include plural components (e.g., members, layers, or elements). For example, as shown in FIG. 2, in some embodiments sole structure 102 may include a bottom component 200, an intermediate component 202, an upper component 204, and a chambered component 206. In some embodiments, upper component 204 may be optional. In some embodiments, chambered component 206 may be optional. In some embodiments, upper component 204 and chambered component 206 may be constructed as a single component, e.g., as a single molded component. In some embodiments, chambered component 206 may be disposed between upper component 204 and intermediate component 202 (in this case, it will be appreciated that a configuration of upper component 204 may vary to accommodate an assembled configuration of intermediate component 202 and chambered component 206). In some embodiments, upper component 204 (and optionally chambered component 206) and bottom component 200 may be constructed as a single component, e.g., as a single molded component that encapsulates intermediate component 202. In some embodiments, two or more of upper component 204, chambered component 206, intermediate component 202, and/or bottom component 200 may be made of one or more materials that are mold compatible. In some embodiments, bottom component 200 may include one or more types of traction elements.

Some embodiments of sole structure 102 may include at least one component having a construction or configuration for providing desired rigidity or structural support to sole structure 102. In some embodiments, sole structure 102 may include one or more rigid components. In some embodiments, a rigid component may extend along the entire length of sole structure 102. In some embodiment, however, a rigid component may extend along only a portion of sole structure 102. A rigid component may provide the wearer with support in order to accelerate, provide stability, and/or may control (facilitate or limit) various desired or undesired foot motions.

Some embodiments of sole structure 102 may include at least one component having a construction or configuration for providing desired flexibility to sole structure 102. In some embodiments, sole structure 102 may include one or more flexible components. In some embodiments, a flexible component may extend along the entire length of sole structure 102. In some embodiments, however, a flexible component may extend along only a portion of sole structure 102. In some embodiments, sole structure 102 may include one flexible component, while in other embodiments sole structure 102 may include more than one flexible component. A flexible component may allow or facilitate the foot to bend and/or twist in order to allow the wearer to quickly maneuver, to change directions, or to accurately position the wearer's foot in a desired direction or orientation.

Some embodiments of sole structure 102 may include at least one component having a construction or configuration for providing desired torsional rigidity to sole structure 102. In some embodiments, at least one component may be provided with a protruding portion having a surface contour or topography throughout at least a portion of a length or width of sole structure 102 to achieve a desired torsional rigidity characteristic in sole structure 102. In some embodiments, a surface contour or topography may be configured to increase a torsional rigidity characteristic (or decrease a flexibility characteristic) of a region of sole structure 102 or component of sole structure 102. In some embodiments, a surface contour or topography may be configured to decrease a torsional rigidity characteristic (or increase a flexibility characteristic) of a region of sole structure 102 or component of sole structure 102. For example, in some embodiments a surface contour of a component may form a point or series of points that define a region of torsional rigidity, e.g., an edge of a protruding portion that forms a generally linear trough in the component may define an axis of torsional rigidity of the component and sole structure 102. In some embodiments, a surface contour or topography may be provided with a variable contour or topography that defines a variable torsional rigidity characteristic in a region of the component and sole component 102. For example, in some embodiments a protruding portion that forms a trough having a deeper or wider concave contour at a first portion (e.g., at a first end) than at a second portion (e.g., at a second end) of the trough, and thus may provide a different (e.g., greater or lesser) torsional rigidity at the first portion (e.g., the first end) than at the second portion (e.g., the second end) of the trough in the component.

Some embodiments of sole structure 102 may include at least one component having a construction or configuration for minimizing an overall weight of sole structure 102. For example, in some embodiments, sole structure 102 may include a chambered or porous component (see, e.g., chambered component 206 in FIG. 2). In some embodiments, a chambered or porous component or a chambered or porous portion of a component may be located in a protruding portion, void, indentation, or cavity formed in one or more other component of sole structure 102. In some embodiments, a component may include a first portion that has a first porous or chambered configuration and a second portion that has a second porous or chambered configuration that is different from the first portion. In some embodiments, one of the first chambered configuration and the second chambered configuration may be a solid or substantially solid configuration or portion. In some embodiments, an overall weight of sole structure 102 may be reduced when a porous or chambered component or portion of the component displaces all or a portion of a heavier component or portion of the component, e.g., a solid component or portion of the component made of the same material.

Some embodiments of sole structure 102 may include at least one component having a thickness that varies throughout at least a portion of a length or width of sole structure 102. In some embodiments, a rigid component may have an increased thickness in a region of sole component 102 where additional rigidity or structural support is desired. In some embodiments, a rigid component may have decreased thickness in a region where less rigidity or structural support is desired. In some embodiments, a flexible component may have an increased thickness in a region of sole component 102 where additional rigidity or structural support is desired. In some embodiments, a flexible component may have decreased thickness in a region where less rigidity or structural support is desired.

As shown in FIG. 2, in some embodiments sole structure 102 optionally may include an upper component 204. In some embodiments, upper component 204 may be formed from a generally flexible material. In some embodiments, upper component 204 may be formed from a generally rigid material. In some embodiments, upper component 204 may be a plate structure. Upper component 204 generally has a top surface 211 and a bottom surface 212. In some embodiments, upper component 204 may be oriented so that top surface 211 of upper component 204 is facing the wearer's foot. In some embodiments, upper component 204 may be adjacent a lower portion of upper 101. Upper component 204 may serve to add durability to sole structure 102 and to form a separation barrier between other components of sole structure 102 and the wearer's foot.

As shown in FIG. 2, in some embodiments sole structure 102 includes an intermediate component 202. In some embodiments, intermediate component 202 may be formed from a rigid material. In some embodiments, intermediate component 202 may be formed of a carbon fiber material. In some embodiments, intermediate component 202 may be an engineered carbon fiber material plate. Intermediate component 202 generally has a top surface 213 and a bottom surface 214. In some embodiments, intermediate component 202 may be oriented so that top surface 213 of intermediate component 202 is adjacent bottom surface 212 of upper component 204 and facing the wearer's foot. In some embodiments, at least a portion of intermediate component 202 (e.g., a peripheral edge portion) may be adjacent a lower portion of upper 101. In some embodiments, intermediate component 202 may serve to provide planar and torsional rigidity to sole structure 102.

As shown in FIG. 2, in some embodiments sole structure 102 may include a bottom component 200. In some embodiments, bottom component 200 may be formed from a generally wear resistant material. Bottom component 200 generally has a top surface 215 and a bottom surface 216. In some embodiments, bottom component 200 may be oriented so that top surface 215 of bottom component 200 is adjacent bottom surface 214 of intermediate component 202 and facing the wearer's foot. In some embodiments, a portion of bottom component 200 (e.g., a peripheral edge portion) may be adjacent a lower portion of upper 101. In some embodiments, bottom component 200 may include at least one traction element exposed on bottom surface 216 of bottom component 200 of sole structure 102 and provide traction relative to a ground surface or other surface.

In some embodiments, a component (e.g., bottom component 200, intermediate component 202, and optionally upper component 204) may have at least one protruding portion. A protruding portion may include a depression or concave contour formed on the top surface of the component, while extending out as a corresponding convex contour from the bottom surface of the component. Therefore, the term "protruding portion" as used throughout this description and the claims, generally refers to both the depression or concave contour on the top surface of the component, as well as the corresponding convex contour on the bottom surface of the component. Referring to FIG. 2, for example, intermediate component 202 generally includes a protruding portion 240 that forms a depression or concave contour on top surface 213 of intermediate component 202, while also forming a corresponding convex contour on bottom surface 214 of intermediate component 202. Similarly, in some embodiments bottom component 200 may include a protruding portion 250 that forms a depression or concave contour on top surface 215 of bottom component 200, while also forming a corresponding convex contour on bottom surface 216 of bottom component 200. And in some embodiments, upper component 204 may include a protruding portion 230 that forms a depression or concave contour on top surface 211 of upper member 204, while also forming a corresponding convex contour on bottom surface 213 of upper member 204.

A protruding portion may include one or more elements. An element of a protruding portion may be formed by one or more contoured surfaces. In some embodiments, intermediate component 202 may include one or more elements or contoured surfaces on top surface 213 and bottom surface 214. In some embodiments, bottom component 200 may include one or more elements or contoured surfaces on top surface 215 and bottom surface 216. And in some embodiments, optional upper component 204 may include one or more elements or contoured surfaces on top surface 211 and bottom surface 212.

Chambered component 206 may include at least one protruding portion. Chambered component 206 generally includes a top surface 217 and a bottom surface 218. In some embodiments, chambered component 206 may be oriented so that top surface 217 of chambered component 206 is facing the wearer's foot. In some embodiments, chambered component 206 may be adjacent a lower portion of upper 101. In some embodiments, at least a portion of top surface 217 may include a surface contour configured to support a foot. Chambered component 206 may serve to add rigidity or structural support to sole structure 102 while reducing an overall weight of sole structure 102.

Referring to FIG. 2, in some embodiment optional upper component 204 may include a protruding portion 230. As shown in FIG. 2, in some embodiments protruding portion 230 may include a first element 231 located in toe region 103 on medial side 107, a second element 232 located in forefoot region 104, a third element 233 located in midfoot region 105, and a fourth element 234 located in heel region 106. In some embodiments, an element of protruding portion 230 may include more than one element portion. For example, as shown in FIG. 2, in some embodiments element 233 generally may have a Y-shaped configuration formed by a first element portion 235 generally located on medial side 107 and a second element portion 236 generally located on lateral side 108. In some embodiments, element 234 may include an element portion 238 located on medial side 107. As shown in FIG. 2, in some embodiments element 231, element 232, element 233 (including element portion 235 and element portion 236), and element 234 (including element portion 238) may form continuous contiguous elements of a single protruding portion 230. In some embodiments, one or more of element 231, element 232, element 233 (including element portion 235 and element portion 236), and element 234 (including element portion 238) may be discontinuous.

Similarly, intermediate component 202 may include a protruding portion 240. As shown in FIG. 2, in some embodiments protruding portion 240 may include a first element 241 located in toe region 103 on medial side 107, a second element 242 located in forefoot region 104, a third element 243 located in midfoot region 105, and a fourth element 244 located in heel region 106. In some embodiments, an element of protruding portion 240 may include more than one element portion. For example, as shown in FIG. 2, in some embodiments element 243 generally may have a Y-shaped configuration formed by a first element portion 245 generally located at medial side 107 and a second element portion 246 generally located at lateral side 108. In some embodiments, element 244 may include an element portion 248 located at medial side 107. As shown in FIG. 2, in some embodiments element 241, element 242, element 243 (including element portion 245 and element portion 246), and element 244 (including element portion 248) may form continuous contiguous elements of a single protruding portion 240. In some embodiments, one or more of element 241, element 242, element 243 (including element portion 245 and element portion 246), and element 244 (including element portion 248) may be discontinuous.

Similarly, bottom component 200 may include a protruding portion 250. As shown in FIG. 2, in some embodiments protruding portion 250 may include a first element 251 located in toe region 103 on medial side 107, a second element 252 located in forefoot region 104, a third element 253 located in midfoot region 105, and a fourth element 254 located in heel region 106. In some embodiments, an element of protruding portion 250 may include more than one element portion. For example, as shown in FIG. 2, in some embodiments element 253 generally may have a Y-shaped configuration formed by a first element portion 255 generally located at medial side 107 and a second element portion 256 generally located at lateral side 108. In some embodiment, element portion 254 may include an element portion 258 located at medial side 107. As shown in FIG. 2, in some embodiments element 251, element 252, element 253 (including element portion 255 and element portion 256), and element 254 (including element portion 258) may form continuous congruous elements of a single protruding portion 250. In some embodiments, one or more of element 251, element 252, element 253 (including element portion 255 and element portion 256), and element 254 (including element portion 258) may be discontinuous.

The number of protruding portions or elements of protruding portions of intermediate component 202, bottom component 200, and optionally upper component 204 may vary in different embodiments. For example, in some embodiments, the number of protruding portions or elements of protruding portions may vary depending on a number of other features of sole structure 102, such as an overall size of sole structure 102 or a number or arrangement of traction elements disposed on bottom component 200.

A geometry of a protruding portion or element of a protruding portion of a component may vary in different embodiments. A shape of a protruding portion or element of a protruding portion in top plan view or bottom plan view may vary in different embodiments. A shape of a protruding portion or element of a protruding portion in profile or sectional shape, e.g., in vertical depth or height profile, may vary in different embodiments. For example, in some embodiments a protruding portion or element may be generally rounded or dome-like in shape. In some embodiments, a protruding portion or element may be generally square or rectangular in shape in plan view. In some embodiments, a protruding portion or element may be triangular in shape in plan view. In some embodiments, a protruding portion or element may have a Y-shaped configuration in plan view. It will be understood that a protruding portion or element may be formed in a wide variety of shapes in plan view, including but not limited to: hexagonal, circular, square, rectangular, trapezoidal, diamond, ovoid, as well as other regular or irregular geometric or non-geometric shapes. Similarly, it will be understood that a protruding portion or element may be formed in a wide variety of shapes in profile or sectional view, including but not limited to: cylindrical, conical, conical frustum, circular, square, rectangular, rectangular frustum, trapezoidal, parabolic, parabolic frustum, as well as other regular or irregular geometric or non-geometric shapes.

Geometries of protruding portions or elements of protruding portions of adjacent components may vary in different embodiments. In some embodiments, protruding portions or elements of protruding portions of two components of sole structure 102 may have a common geometry that allows the two components to be disposed on one another so that the protruding portion (or element) of one component is received in the protruding portion (or element) of another component, e.g., the two components may be disposed in a stacked, interfitting, or nested manner. For example, as shown in FIG. 2, in some embodiments a geometry of protruding portions or elements of the protruding portions of intermediate component 202 and bottom component 200 may correspond such that intermediate component 202 may be disposed on bottom component 200 in a stacked, interfitting, or nested manner. Similarly, as shown in FIG. 2, in some embodiments a geometry of protruding portions or elements of the protruding portions of upper component 204, intermediate component 202, and bottom component 200 may correspond such that upper component 204 and intermediate component 202 may be disposed on bottom component 200 in a stacked, interfitting, or nested manner.

In some embodiments, sole structure 102 may include a chambered component 206. A configuration of chambered component 206, including size and shape (geometry) and construction, may vary in different embodiments. As shown in FIG. 2, in some embodiments a configuration of chambered component 206 generally may vary in correspondence with a protruding portion of another component of sole structure 102. For example, as shown in FIG. 2, in some embodiments a geometry of chambered component 206 generally may correspond with one or more elements of protruding portion 230 of upper component 204. As shown in FIG. 2, in some embodiments a geometry of chambered component 206 generally may correspond with one or more elements of protruding portion 240 of intermediate member 202. And as shown in FIG. 2, in some embodiments a geometry of chambered component 206 generally may correspond with one or more elements of protruding portion 250 of bottom component 200. It will be appreciated that, as shown in FIG. 2, in this manner chambered component 206 also may be disposed in a stacked, interfitting, or nested manner with upper component 204, intermediate component 206, and/or bottom component 200. It also will be appreciated that, as shown in FIGS. 1 and 2, in this manner chambered component 206 may be disposed in a stacked, interfitting, or nested manner with upper 101, upper component 204, intermediate component 206, and/or bottom component 200.

A geometry of chambered component 206 may vary in different embodiments. As shown in FIG. 2, a geometry of chambered component 206 may correspond to one or more elements of another component of sole structure 102. For example, as shown in FIG. 2, in some embodiments chambered component 206 may have a first element 261 located in a toe region 103 on medial side 107, a second element 262 located in forefoot region 104, a third element 263 located in midfoot region 105, and a fourth element 264 located in heel region 106. In some embodiments, an element of chambered component 206 may include more than one element portion. For example, as shown in FIG. 2, in some embodiments element 263 generally may have a Y-shaped configuration formed by a first element portion 265 generally located at medial side 107 and a second element portion 266 generally located at lateral side 108. In some embodiments, element 264 may include an element portion 268 generally located at medial side 108. As shown in FIG. 2, in some embodiments element 261, element 262, element 263 (including element portion 265 and element portion 266), and element 264 (including element portion 268) may form continuous contiguous elements of a single chambered component 206. In some embodiments, one or more of element 261, element 262, element 263 (including element portion 265 and element portion 266), and element 264 (including element portion 268) may be discontinuous. It will be appreciated that a geometry of chambered component 206 may include any other regular or irregular geometrical or non-geometrical shape corresponding with at least one element or portion of another component of sole structure 102.

Chambered component 206 may function to increase a rigidity (i.e., strengthen) of sole structure 102 while at the same time decreasing an overall weight of sole structure 102. In some embodiments chambered component 206 may be made from a material or mixture of materials that is different than a material or materials of other components of sole structure 102, i.e., a material or mixture of materials that is lighter than a material of another component. In some embodiments, chambered component 206 may be made from the same material as one or more other components, but have a porous or chambered construction. In some embodiments, chambered component 206 may be made from recycled material used to make up one or more other components. It will be appreciated that decreasing the weight of sole structure 102 may allow the wearer to move more quickly and efficiently, therefore enhancing the wearer's performance.

A construction of chambered component 206 may vary in different embodiments. In some embodiments, at least a portion of chambered component 206 may be porous or include a plurality of internal chambers. In other words, a volume of at least a portion of chambered component 206 may include a plurality of open or closed cells or cavities that may be partitioned off from one another, e.g., by cell walls. For example, in some embodiments a volume of one or more elements of chambered component 206 may be formed by a plurality of hexagon-shaped columns forming a honeycomb pattern. In some embodiments, a volume of at least a portion of chambered component 206 may be formed by a plurality of any geometrically-shaped columns. In some embodiments, chambered component 206 variously may be formed by a plurality of ribs, ridges, webs, or other protuberances formed on top surface 217 of chambered component 206. For example, as illustrated in FIG. 2, in some embodiments a volume of element 263 (including element portion 265 and element portion 266) and element 264 (including element portion 268) of chambered component 206 may be formed by a plurality of intersecting or cross-hatched walls. As shown in FIG. 2, in some embodiments at least an element or a portion of chambered component 206 may be solid or substantially solid. For example, in some embodiments element 261 in toe region 103 and element 262 in forefoot region 104 may be solid or substantially solid. It will be appreciated that this configuration may provide a smooth continuous top surface 217 below a portion of a user's foot that is pressure sensitive, such as the balls of the foot and a lower portion of the big toe.

A location of protruding portions or elements of protruding portions in components of sole structure 102 may vary in different embodiments. For example, in some embodiments the location of element 245 of protruding portion 240 of intermediate component 202 may vary. In some embodiments, a location of protruding portion 240 of intermediate component 202 may vary in a longitudinal direction of sole structure 102. For example, in some embodiments protruding portion 240 may be shifted in a longitudinal direction so that element 245 is located further toward heel region 106, to locate an axis of torsional rigidity of sole structure 102 closer to heel region 106.

Sole structure 102 may include one or more traction elements. In some embodiments, a traction element may be a cleat member. The term "cleat member" as used in this description and throughout the claims includes any exposed structure disposed on a sole structure for increasing traction through friction or penetration of a ground surface. Typically, cleat members may be configured for any type of activity that requires traction. In some embodiments, a traction element may be any exposed structure disposed on a surface of the sole structure configured for increasing traction through friction relative to any other surface, such as a ground surface or a surface of a ball.

In some embodiments, bottom component 200 may include a plurality of traction elements disposed on bottom surface 216. In some embodiments, a traction element may form a cleat member. For example, as shown FIG. 1, in some embodiments bottom component 200 may include a first traction element 121, a second traction element 122, and a third traction element 123 on medial side 107 of toe region 103, and a fourth traction element 124 on lateral side 108 of toe region 103, fifth traction element 131 on medial side 107 of forefoot region 104, a sixth traction element 132 in a central region of forefoot region 104, and a seventh traction element 133 on lateral side 108 of forefoot region 104, an eight traction element 141 and a ninth traction element (rear medial heel traction element) 142 on medial side 107 of heel region 106, and a tenth traction element 143 and an eleventh traction element (rear lateral heel traction element) 144 on lateral side 108 of heel region 106. As shown in FIG. 1, in some embodiments each of these traction elements generally may form a blade cleat member.

A configuration of a traction element forming a cleat member, including at least size and shape, may vary in different embodiments. For example, as shown in FIG. 1, in some embodiments (e.g., traction element 121, traction element 122, and traction element 123) a traction element may have a generally curved planar shape, e.g., forming a curved blade cleat. In some embodiments (e.g., traction element 131, traction element 141, traction element 142, traction element 143, and traction element 144), a traction element may have a generally flat planar shape, e.g., forming a straight blade cleat. In some embodiments (e.g., traction element 124, traction element 132, and traction element 133), a traction element may have an angled planar shape, e.g., forming a chevron-shaped cleat or right-angled-shaped blade cleat. In some embodiments, a traction element may have any regular or irregular geometric or non-geometric shape.

A traction element may include an additional support structure. For example, as shown in FIG. 1, in some embodiments (e.g., traction element 121, traction element 122, traction element 123, traction element 124, traction element 131, traction element 132, traction element 133, traction element 141, traction element 142, traction element 143, and traction element 144), a traction element (cleat member) may include a base support webbing. In some embodiments, traction element 121, traction element 122, and traction element 123 are supported at web portion 111 that is formed by a thickened portion of bottom component 200 at medial side 107 of toe region 103, and traction element 124 is supported at web portion 112 that is formed by a thickened portion of bottom component 200 at lateral side 108 of toe region 103. Similarly, in some embodiments traction element 131, traction element 132, traction element 133 are supported at web portion 113 that is formed by a thickened portion of bottom component 200 and generally extends laterally at forefoot region 104. In some embodiments (e.g., traction element 124, traction element 131, and traction element 133), a traction element (cleat member) may include an additional longitudinal support structure, such as a buttress located adjacent at least one longitudinal end of a blade cleat member. In some embodiments (e.g., traction element 131, traction element 141, traction element 142, traction element 143, and traction element 144), a traction element (cleat member) may be associated with additional lateral support structure, such as a buttress located at a lateral side of a blade cleat member. In some embodiments (e.g., traction element 141 and traction element 142 or traction element 143 and traction element 144), at least two traction elements may be connected with one another by common support structure, such as a common buttress or web structure connecting longitudinal ends of two adjacent blade cleat members elements. In each case, a support structure (such as a web, buttress, rib, ridge, or other support structure) may be formed by a thickened portion of the thickness profile of bottom component 200.

In some embodiments, a traction element may be combined with another structure of the sole component configured to perform another function. For example, as shown in FIG. 1, in some embodiments sole structure 102 may include a twelfth traction element 151 and/or thirteenth traction element 152. In some embodiments, twelfth traction element 151 and/or thirteenth traction element 152 may form a crescent-shaped ridge. For example, in some embodiments twelfth traction element 151 and thirteenth traction element 152 may form an outer toe perimeter ball control traction element and an inner toe ball control traction element, respectively, for facilitating control of a soccer ball (see, e.g., soccer ball 700 in FIG. 7). A number and size of these traction elements may vary. For example, as shown in FIG. 1, traction element 151 and traction element 152 may be different sizes (including, e.g., length, width, and height). In some embodiments, traction element 151 and traction element 152 may be approximately the same size. A number of traction elements for ball control may vary in different embodiments.

In some embodiments, a traction element may be combined with a further structure of the sole structure for performing a further function. For example, as shown in FIG. 1, in some embodiments bottom component 200 of sole structure 102 may include a rib 110 disposed on bottom surface 216 and, in some embodiments rib 110 may include a fourteenth traction element 161. As shown in FIG. 1, in some embodiments traction element 161 may include a plurality of projections (e.g., teeth) formed on an exposed bottom surface of rib 110. As shown in FIG. 1, rib 110 may be configured to extend diagonally (i.e., longitudinally and laterally) from a medial side 107 at forefoot region 104 through midfoot region 105 to a lateral side 108 of heel region 106. In some embodiments, a configuration (including a direction of extension) of rib 110 and traction element 161 may correspond to a direction of natural foot movement in a walking or running stride, e.g., from a heel strike location at a lateral heel region to a toe off location at a medial forefoot or medial toe region. As shown in FIG. 1, in some embodiments projections (teeth) of traction element 161 may be raked, e.g., angled forward or rearward along a direction of natural foot movement in stride, to facilitate desired traction with a soccer ball (see, e.g., traction element 161 and soccer ball 700 in FIG. 8).

A traction element may have a composite construction that varies in different embodiments. In some embodiments, a traction element may be a blade cleat that includes a rigid blade member or insert. As shown in FIG. 1, in some embodiments one or more of traction element 121, traction element 122, traction element 123, traction element 124, traction element 131, traction element 132, traction element 133, traction element 141, traction element 142, traction element 143, and traction element 144 may include a rigid blade member or insert. For example, in some embodiments traction element (blade cleat) 131 may include a rigid blade member or insert 171 (shown in phantom). In some embodiments, a rigid blade member or insert may be made of metal. In some embodiments, a rigid blade member or insert may be made of a hard plastic material, such as nylon. In some embodiments (e.g., traction element 141 and traction element 141; or traction element 143 and traction element 144), two traction elements may share a common blade member or insert. For example, as shown in FIG. 1, in some embodiments traction element 141 and traction element 142 may share a common rigid blade member or insert 172. It will be appreciated that this configuration may provide a desired common degree of rigidity to these traction element structures. In some embodiments, this configuration may provide a desired degree of overall traction and stability of sole structure 102 relative to a ground surface. In some embodiments, a blade member or insert may be completely embedded in a traction element, to provide a desired rigidity characteristic for the traction element. In some embodiments, a blade member or insert may include an exposed portion, e.g., that protrudes from a bottom surface of a traction element, for engaging or penetrating a ground surface. In some embodiments, a blade member or insert may be joined with a traction element by a molding process. Those skilled in the art will appreciate alternative structures and methods for making a traction element including a blade cleat or inserts suitable for a desired article of footwear and use.

The number and location of traction elements in bottom component 200 may vary in different embodiments. Although bottom component 200 illustrated in FIG. 1 includes a total of eleven traction elements formed as cleat members, two traction elements formed as ball control elements in the toe region, and one traction element formed as a toothed ball control element on a diagonal rib in the midfoot region, other embodiments may include more or fewer traction elements configured for performing similar or other functions. For example, in some embodiments bottom component 200 may include at least one traction element for ball control at heel region 106.

Assembled Sole Structure Features

A bottom component, intermediate component, optional upper component, and/or optional chambered component variously may be assembled together to form an assembled or composite sole structure. For example, as shown in FIG. 2, in some embodiments bottom component 200, intermediate component 202, optional upper component 204, and optional chambered component 206 variously may be assembled together to form assembled sole structure 102. In some embodiments, assembled sole structure 102 may be a composite plate, i.e., a composite sole plate.

Figure 3:
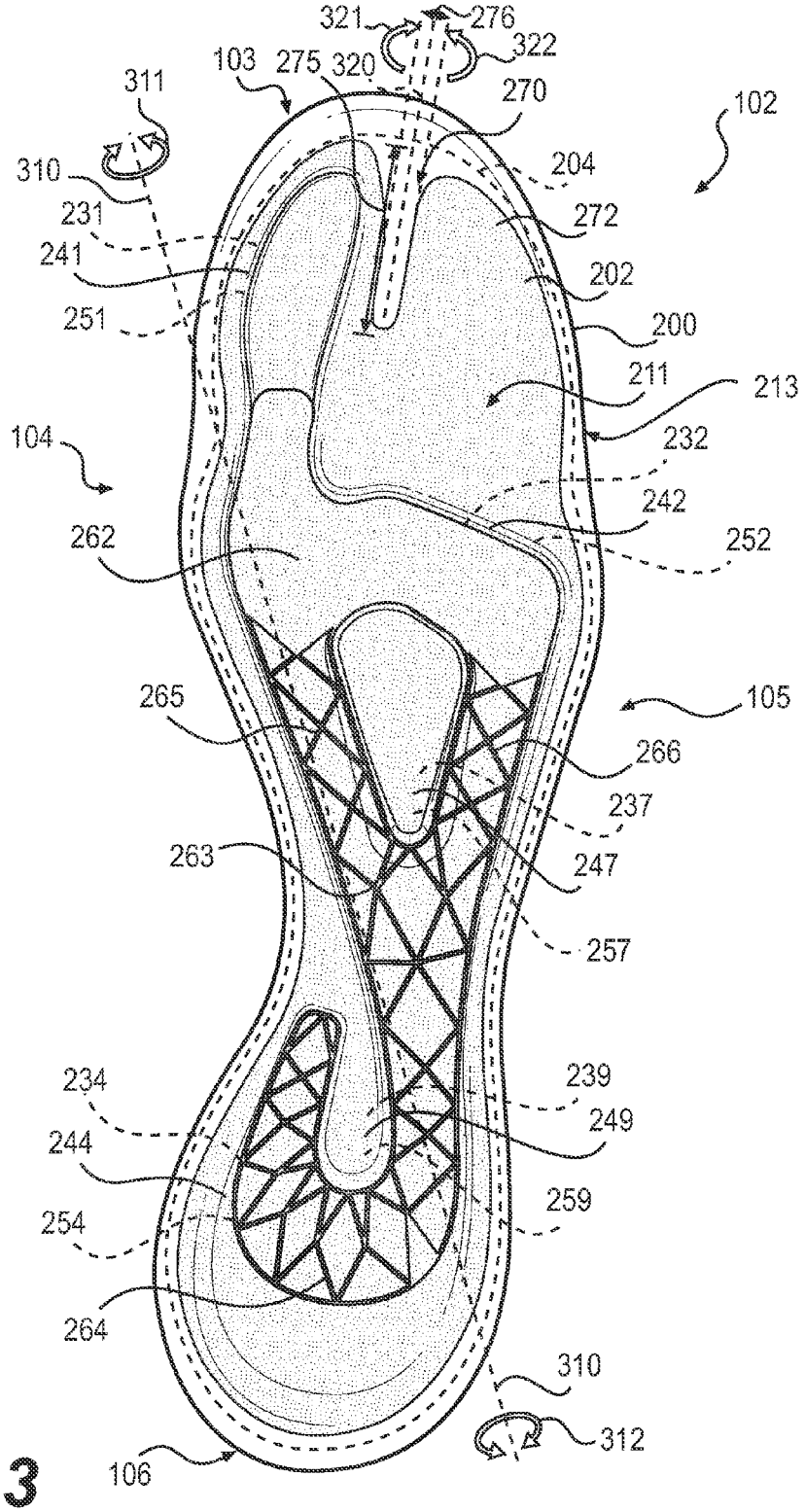
FIG. 3 is a top plan view of an embodiment of the sole structure of FIGS. 1 and 2.
Figure 4:
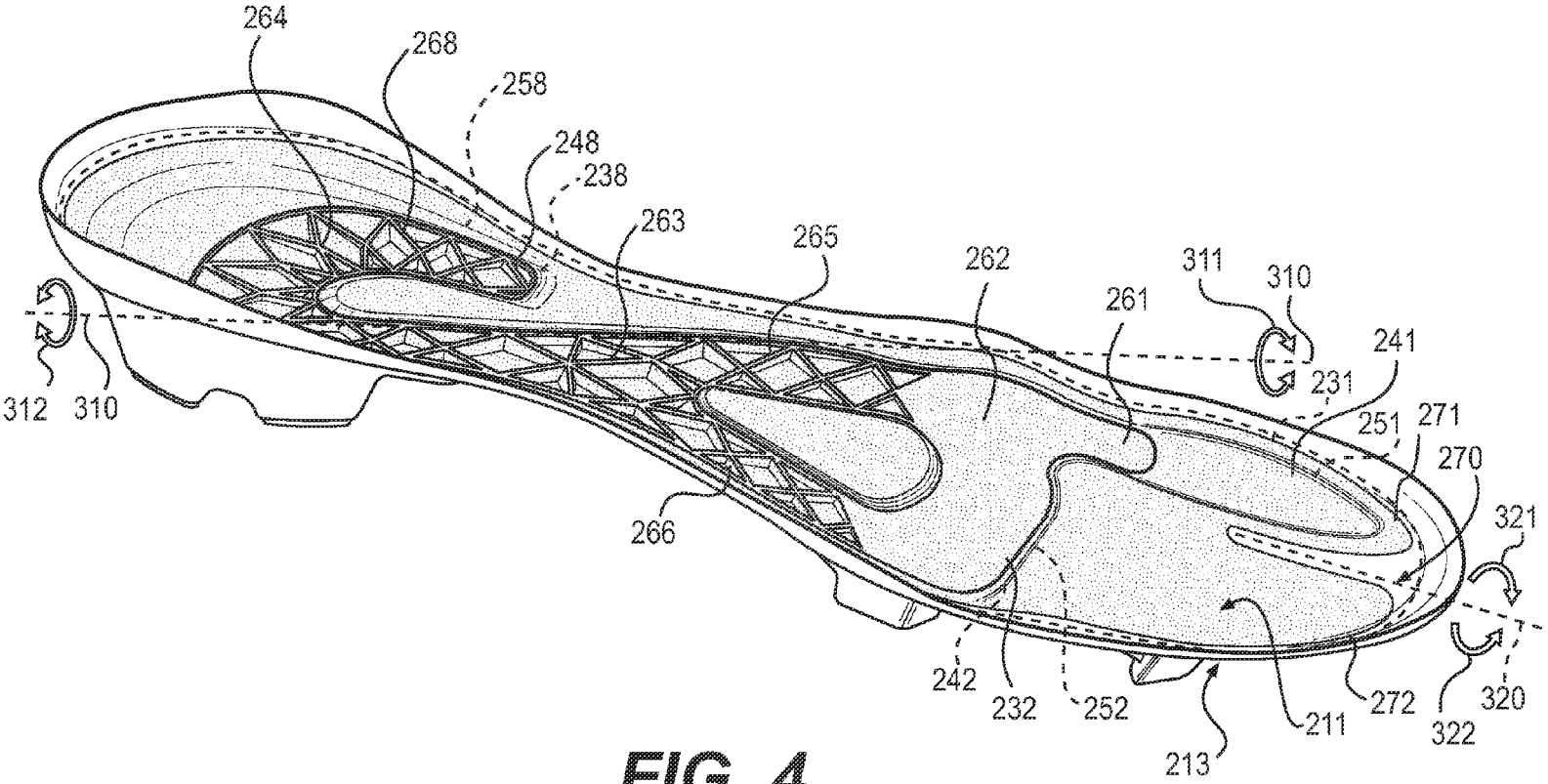
FIG. 4 is a perspective view of the sole structure of FIG. 3 viewed from a top lateral side.
Figure 5:
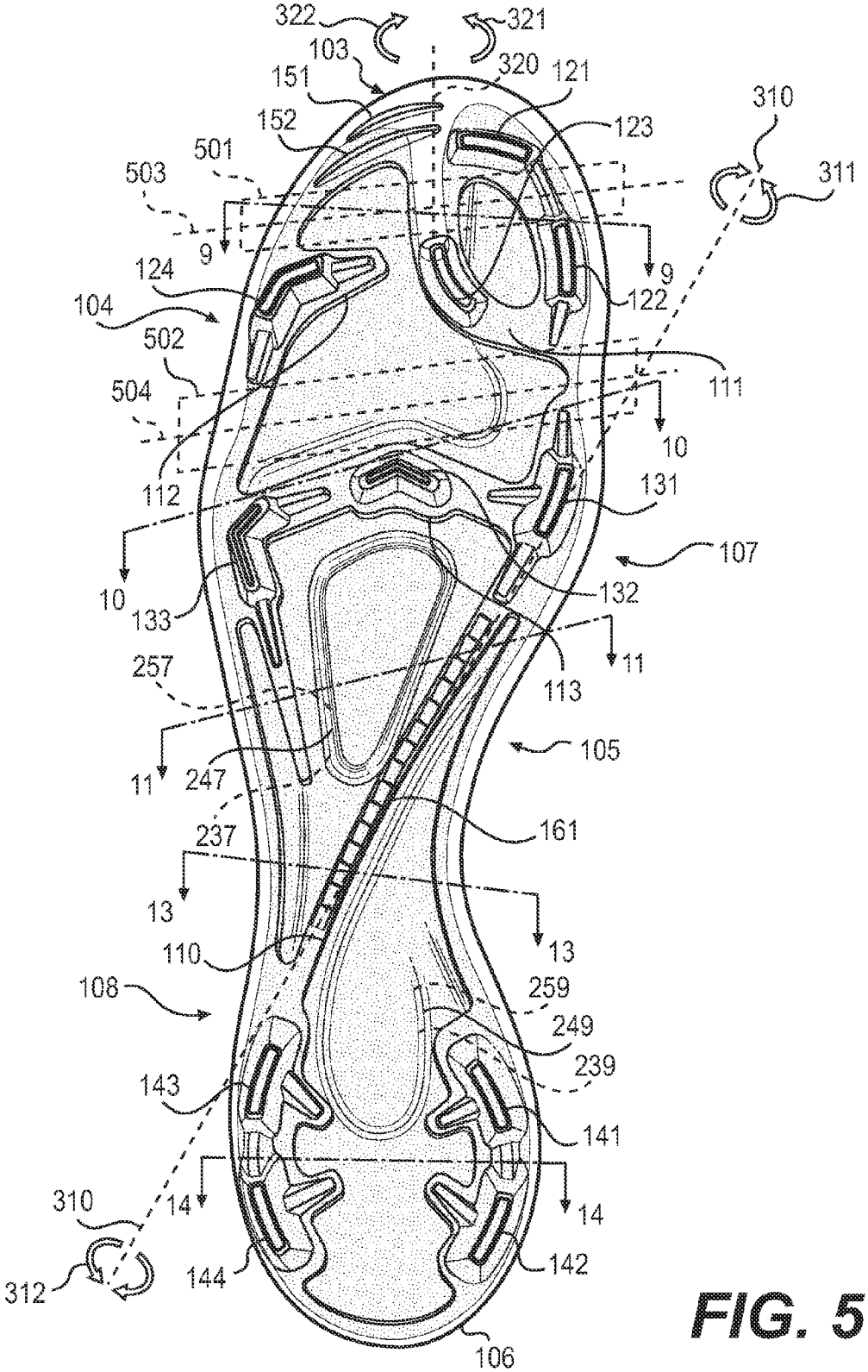
FIG. 5 is a bottom plan view of the sole structure of FIG. 3, including several section lines at different points along a longitudinal length of the sole structure.
Figure 6:
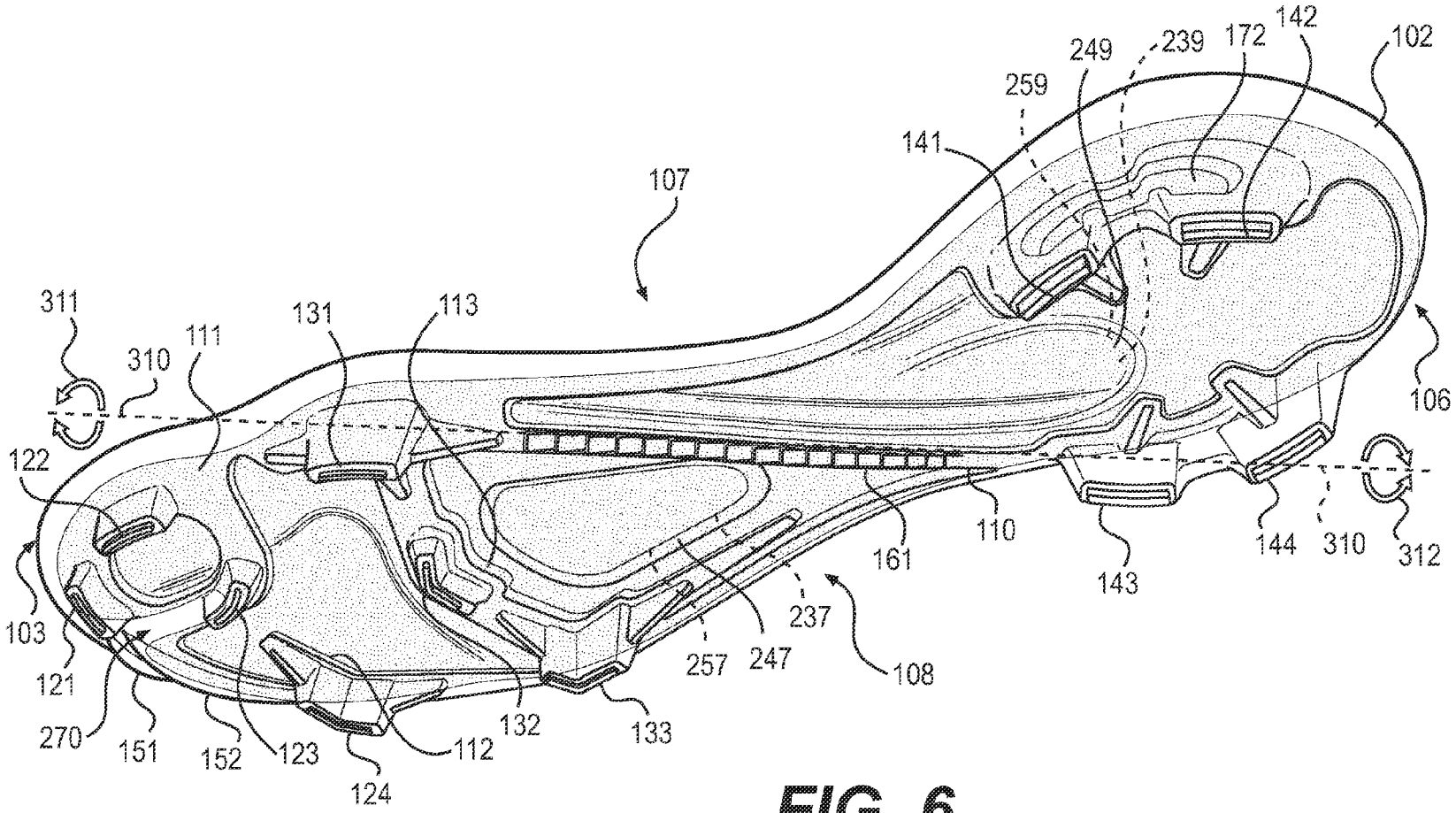
FIG. 6 is a perspective view of the sole structure of FIG. 3 viewed from a bottom medial side.
Figure 7:
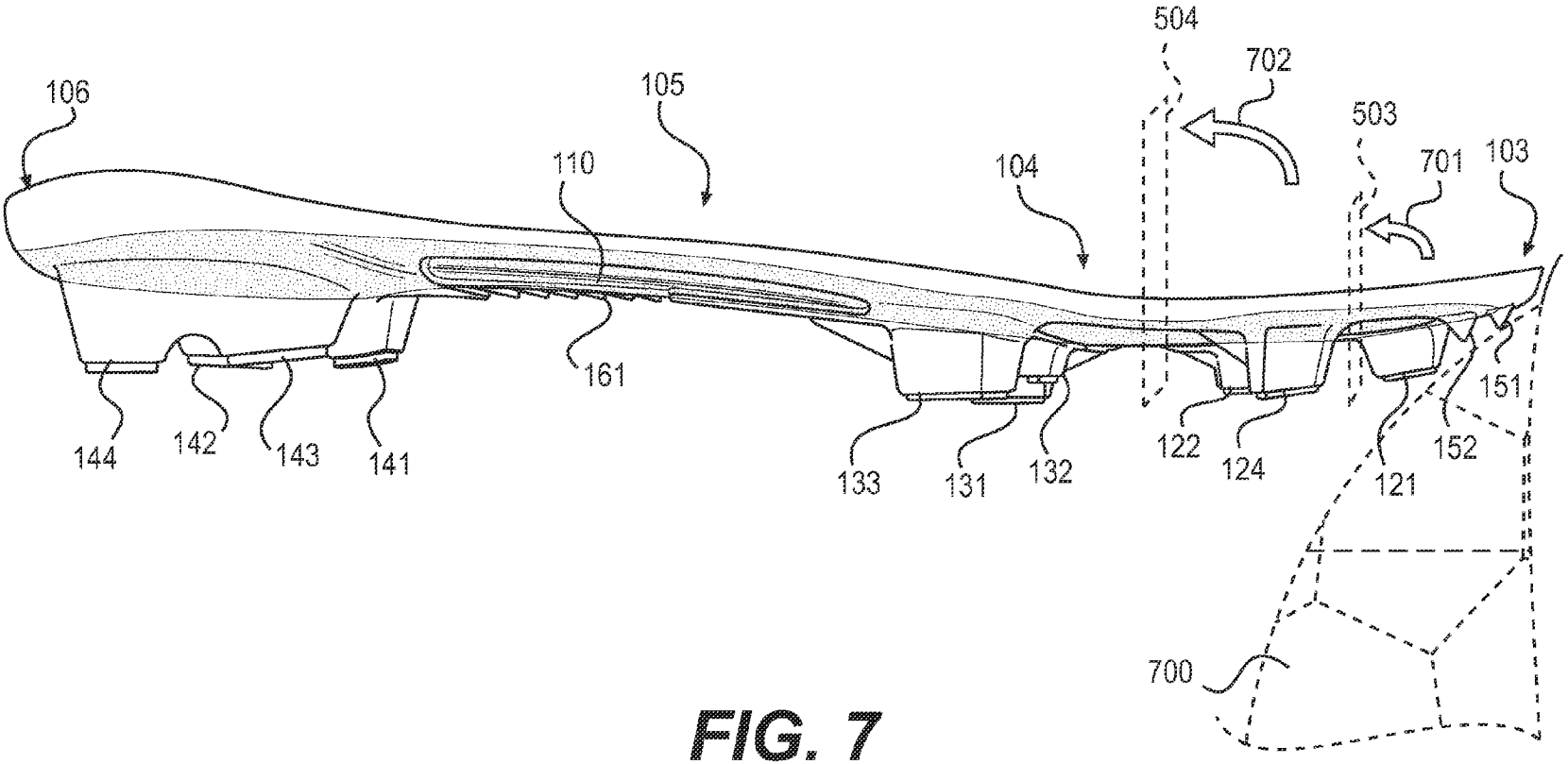
FIG. 7 is a lateral side view of the sole structure of FIG. 3.
Figure 8:
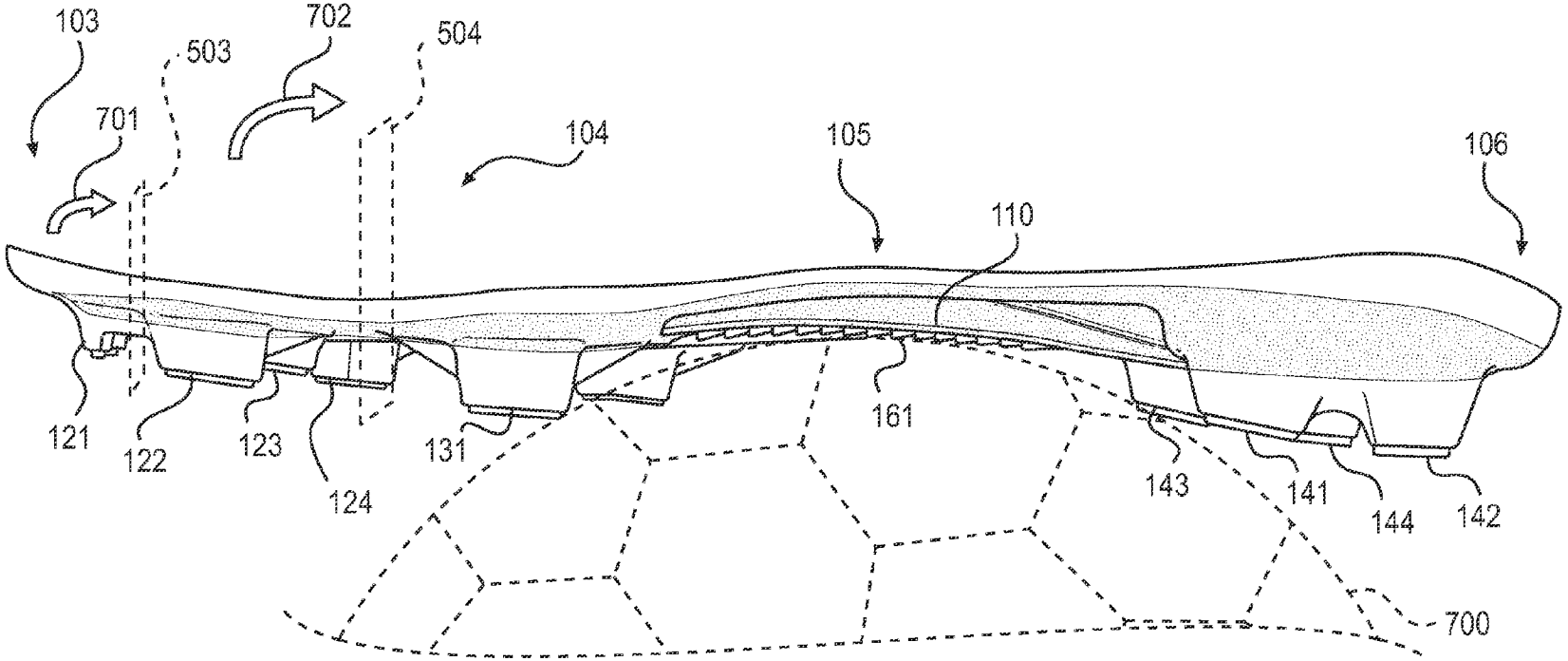
FIG. 8 is a medial side view of the sole structure of FIG. 3.

FIGS. 3 to 14 illustrate various views and features of an embodiment of assembled sole structure 102 of FIGS. 1 and 2. FIG. 3 is a top plan view of an embodiment of sole structure 102 of FIGS. 1 and 2, and FIG. 4 is a perspective view of sole structure 102 of FIG. 3 viewed from a top lateral side. In FIGS. 3 and 4, upper component 204 is illustrated as being composed of a clear material (see dotted lines at the periphery of upper component 204), and intermediate component 202 is shown by stipple shading to illustrate relative configurations and features of the various components of an embodiment of assembled sole structure 102. Similarly, FIG. 5 is a bottom plan view of sole structure 102 of FIG. 3, and FIG. 6 is a perspective view of sole structure 102 of FIG. 3 viewed from a bottom medial side. In FIGS. 5 and 6, bottom component 200 is illustrated as being composed of a clear material to illustrate features of other components of sole structure 102, and intermediate component 204 is illustrated by stipple shading to illustrate relative configurations and features of the various components of an embodiment of assembled sole structure 102. FIG. 7 is a lateral side view of the sole structure of FIG. 3, and FIG. 8 is a medial side view of the sole structure of FIG. 3.

Figure 9:
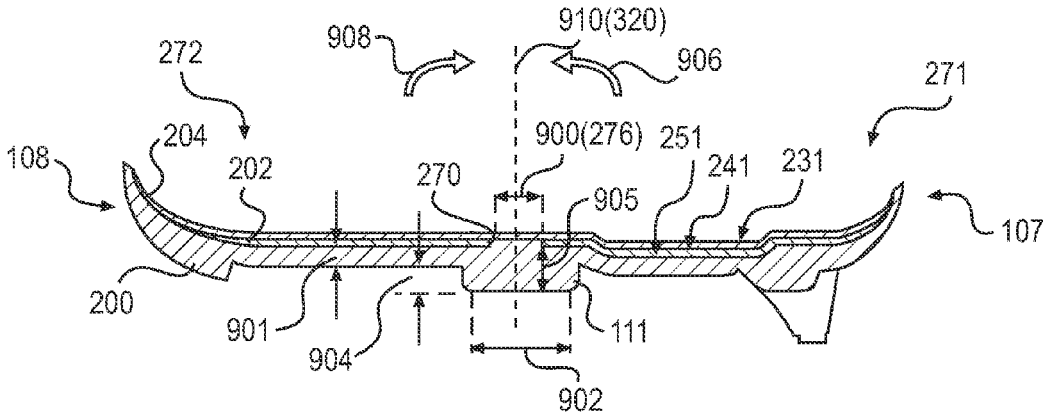
FIG. 9 is a cross-sectional view of the sole structure of FIG. 5, taken along section line 9-9 in FIG. 5.
Figure 10:
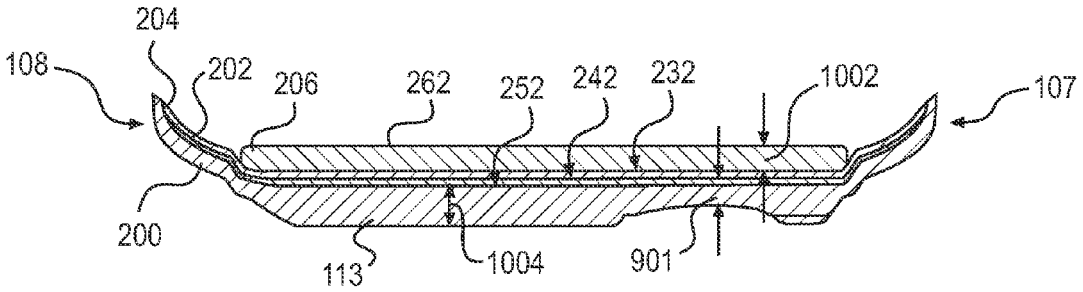
FIG. 10 is a cross-sectional view of the sole structure of FIG. 5, taken along section line 10-10 in FIG. 5.
Figure 11:
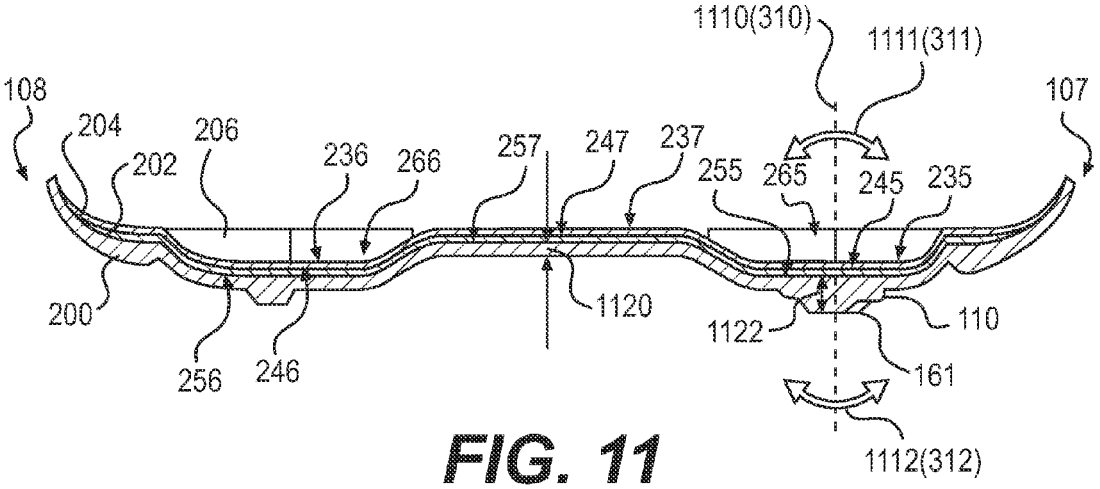
FIG. 11 is a cross-sectional view of the sole structure of FIG. 5, taken along section line 11-11 in FIG. 5.
Figure 12:
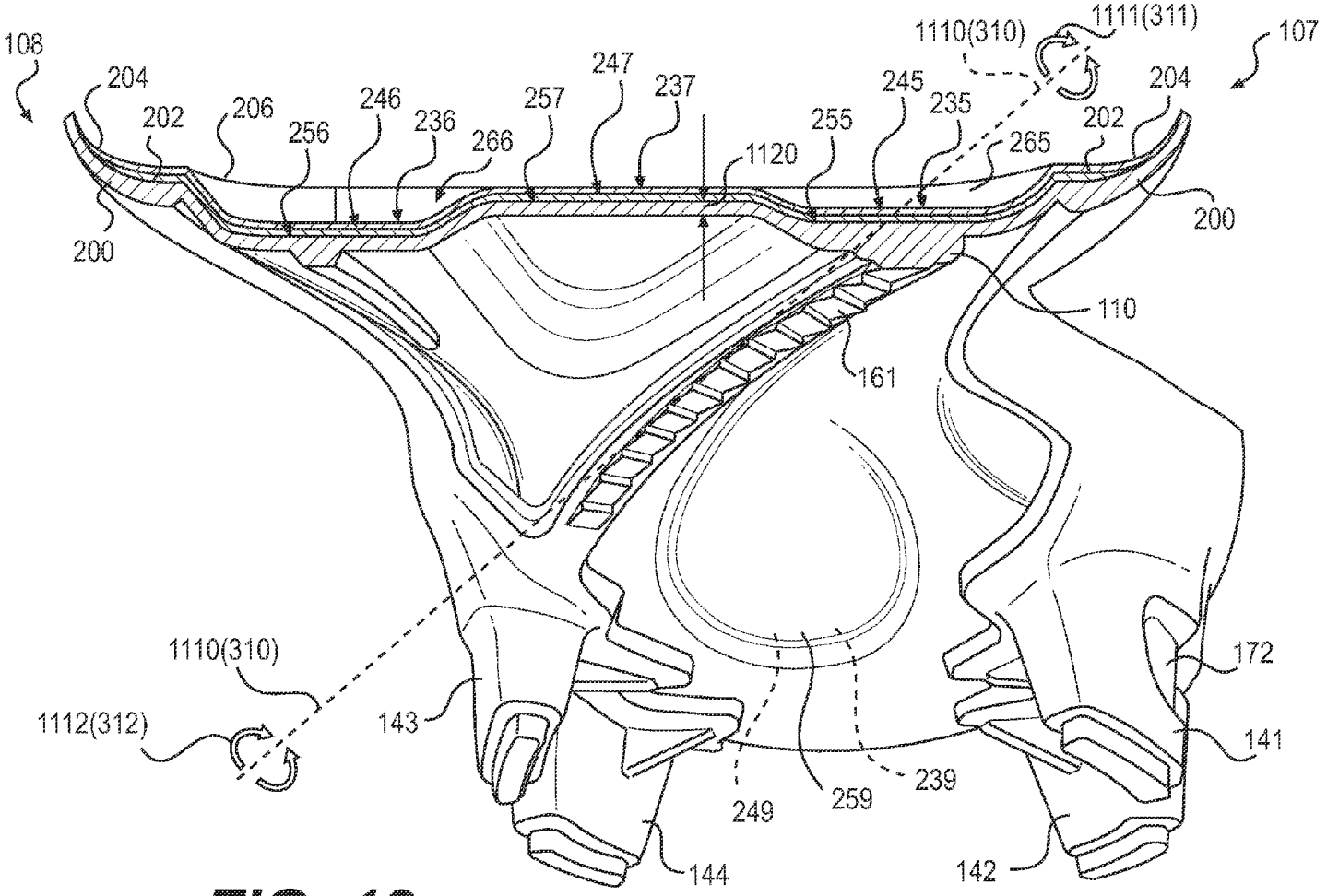
FIG. 12 is a perspective view of the heel region of the sole structure of FIG. 5 viewed along section line 11-11 of FIG. 5.
Figure 13:
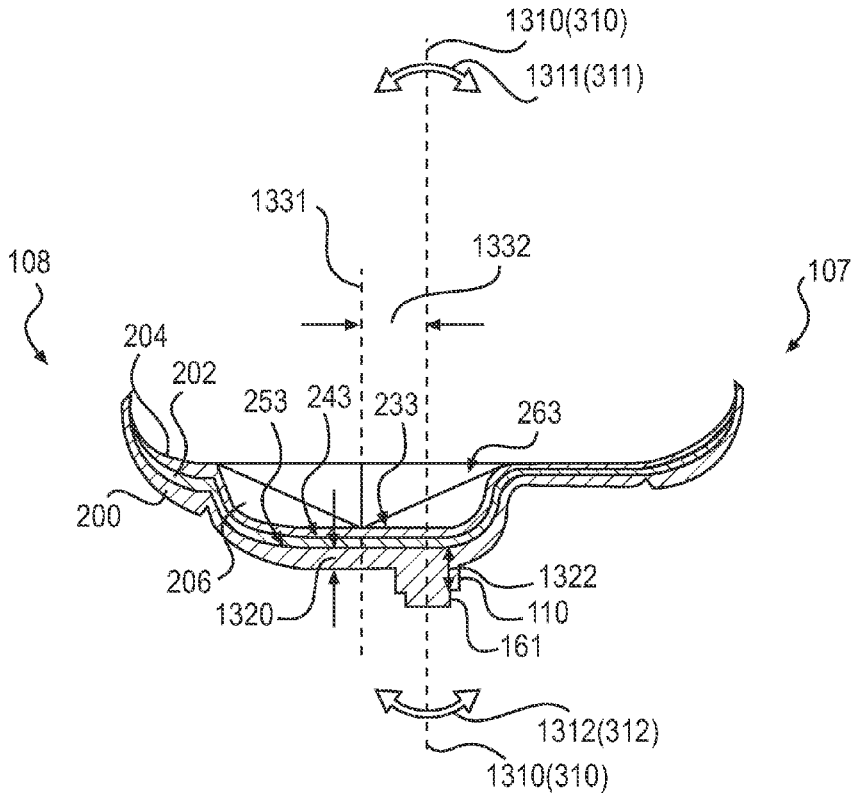
FIG. 13 is a cross-sectional view of the sole structure of FIG. 5, taken along section line 13-13 in FIG. 5.
Figure 14:
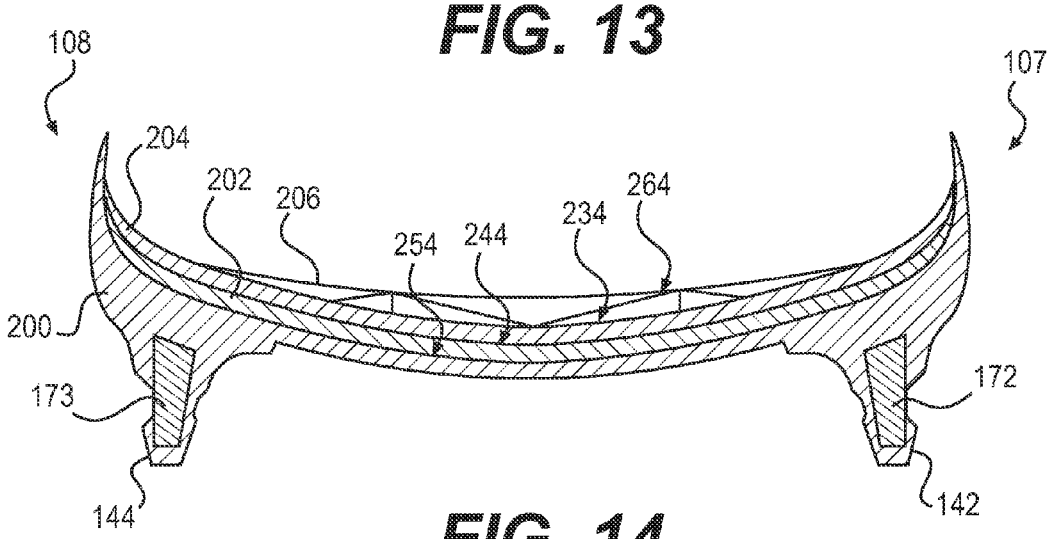
FIG. 14 is a cross-sectional view of the sole structure of FIG. 5, taken along section line 14-14 in FIG. 5.

Construction and features of the assembled sole structure also may be illustrated by sectional views. FIG. 5 includes several section lines at different points along a longitudinal length of sole structure 102 corresponding to sectional views illustrated in FIGS. 9 to 14. FIG. 9 is a cross-sectional view of the sole structure of FIG. 5, taken along section line 9-9 in FIG. 5. FIG. 10 is a cross-sectional view of the sole structure of FIG. 5, taken along section line 10-10 in FIG. 5. FIG. 11 is a cross-sectional view of the sole structure of FIG. 5, taken along section line 11-11 in FIG. 5, and FIG. 12 is a perspective view of the heel region of the sole structure viewed along section line 11-11 of FIG. 5. FIG. 13 is a cross-sectional view of the sole structure of FIG. 5, taken along section line 13-13 in FIG. 5. And FIG. 14 is a cross-sectional view of the sole structure of FIG. 5, taken along section line 14-14 in FIG. 5.

Components shown in FIGS. 1 and 2 variously may be assembled and/or joined with one another in different embodiments. In some embodiments, components shown in FIG. 1 may be joined together to form article of footwear 100. In some embodiments, components shown in FIG. 2 may be joined together to form sole structure 102 or article of footwear 100. In some embodiments, the bottom surface 218 of chambered component 206 may be placed in, and attached to (e.g., by bonding), protruding portion 230 located in the top surface 211 of upper component 204. In some embodiments, the bottom surface 218 of chambered component 206 may be placed in, and attached to (e.g., by bonding), protruding portion 240 located in the top surface 213 of intermediate component 202. In some embodiments, upper component 204 may be place on and attached to (e.g., by bonding) intermediate component 202. In some embodiments, the bottom surface 212 of upper component 204 may be joined with the top surface 213 of intermediate component 202, e.g., by bonding. In some embodiments, the top surface 217 of chambered component 206 may also be attached to the bottom surface 218 of upper component 204, e.g. by bonding. In some embodiments, the bottom surface 214 of intermediate component 202 may be attached to the top surface 215 of bottom component 200, e.g., by bonding.

Interfitting or Nested Features

In some embodiments, protruding portions in each component may be aligned or mated with one another e.g., in a stacked, interfitting or nested manner, when forming assembled sole structure 102. In some embodiments, protruding portion 230 in upper component 204, protruding portion 240 in intermediate component 202, and protruding portion 250 in bottom component 200 may be mated, e.g., in a stacked, interfitting, or nested manner, when forming sole structure 102. In particular, the convex surface portion of protruding portion 230 in upper component 204 may fit into the depression or concave surface portion of protruding portion 240 in intermediate component 202. Likewise, the convex surface portion of protruding portion 240 in intermediate component 202 may fit into the depression or concave surface portion of protruding portion 250 in bottom component 200.

General Sole Structure Rigidity Features

A rigidity (flexibility) characteristic or profile of sole structure 102 may vary in different embodiments. In some embodiments, a rigidity of sole structure 102 may be increased by joining chambered component 206 with at least one of upper component 204 and intermediate component 202. FIG. 2 generally shows an embodiment of sole structure 102 including a relationship between chambered component 206, upper component 204, and intermediate component 202, where upper component 204 includes protruding portion 230 formed to stack, interfit, or nest with protruding portion 240 of intermediate component 202. In this case, a volume of chambered component 206 may be configured to be accommodated in protruding portion 230 in upper component 204. In some embodiments, the concave surface forming protruding portion 230 may support the bottom surface 218 of chambered component 206. In other embodiments (e.g., where optional upper component 204 is not included, or where upper component 204 is disposed on a top surface of chambered component 206 (not shown in FIG. 2)), a volume of chambered component 206 may be configured to be accommodated directly in protruding portion 240 of intermediate component 202.

A surface configuration and associated rigidity of components of sole structure 102 may vary in different embodiments. As shown in FIG. 2, in some embodiments intermediate component 202 may include at least protruding portion 240. In some embodiments, protruding portion 240 may include multiple elements or element portions. For example, as shown in FIG. 2, in some embodiments protruding portion 240 of intermediate component 202 may include at least first element 241 in toe region 103, second element 242 in forefoot region 105, third element 243 in midfoot region 105, and fourth element 244 in heel region 106, where third element 243 may be Y-shaped and include fifth element portion 245 generally located on medial side 107 and sixth element portion 246 located on lateral side 108, and element 244 may include element portion 248 on medial side 107. In some embodiments, each element may have any regular or non-regular geometric or non-geometric configuration (including shape in plan view). In some embodiments, contoured surfaces of intermediate component 202 may be engineered to include rounded contour or transition surface (s). In some embodiments, surface contours of intermediate component 202 may be engineered to include generally squared contour or transition surface(s). It will be appreciated that the surface contours of these elements may provide intermediate component 202 with a desired rigidity characteristic or profile, e.g., a desired planar rigidity characteristic and torsional rigidity characteristic (discussed further below).

In some embodiments, base component 200 and/or upper component 204 may have corresponding surface contour configurations and bottom component 200, intermediate component 202, and optional upper component 204 may be arranged in a stacked, interfitting, or nested manner. It will be appreciated that the surface contours of these elements and components may provide the respective and/or collective component(s) with a desired rigidity characteristic or profile, e.g., a desired planar rigidity characteristic and torsional rigidity characteristic (further discussed below), that facilitates formation of a desired axis of torsional rigidity in sole structure 102. Those skilled in the art readily will be able to select surface contours for achieving a desired configuration and rigidity characteristic or rigidity profile for each element, component, sole structure 102, and article of footwear 100 consistent with this disclosure.

Toe Region Rigidity Features

A configuration and associated rigidity (or flexibility) profile of sole structure 102 in toe region 103 may vary in different embodiments. For example, as shown in FIGS. 2 to 5 and 9, in some embodiments sole structure 102 may be provided with a toe split structure that enables a first range of motion for one portion of toe region 103, i.e., a portion located below the big toe at medial side 107 of toe region 103, and a second range of motion for another portion of toe region 103, i.e., a portion below the remainder of the toes generally located at lateral side 108 of toe region 103. As shown in FIGS. 2 to 5 and 9, in some embodiments sole structure 102 may be configured to modify or control a rigidity (or flexibility) profile of sole structure 102 in toe region 103 to provide a desired range of motion in toe region 103.

As shown in FIG. 2, in some embodiments intermediate component 202 may include a slot 270 formed in toe region 103 that separates toe region 103 into a first or medial toe portion 271 and a second or lateral toe portion 272. As shown in FIG. 2, with this configuration medial toe portion 271 may have a first range of motion (degree of freedom) in a vertical or up and down direction generally indicated by arrow 273, and lateral toe portion 272 may have a second range of motion (degree of freedom) in a vertical or up and down direction generally indicated by arrow 274. It will be appreciated that range of motion 273 and range of motion 274 may vary based on a number of factors including, but not limited to, the material of intermediate component 202, a configuration of intermediate component 202 at toe region 103 (including at least thickness and surface configuration), a length $L_{TS}$ 275 of slot 270, a width $W_{TS}$ 276 of slot 270, and a shape of slot 270. It also will be appreciated that, in some embodiments, range of motion 273 and range of motion 274 may be at least partially independent for intermediate component 202 in a stand-alone configuration.

A range of motion of medial toe portion 271 and lateral toe portion 272 may be modified or controlled in assembled sole structure 102. For example, as shown in FIGS. 3 to 5 and 9, in some embodiments intermediate component 202 may be assembled with and/or joined to bottom component 200 and upper component 204 as a single composite sole plate structure, e.g., by molding or bonding process. It will be appreciated that, with such construction, a range of motion of medial toe portion 271 and a range of motion of lateral toe portion 272 may be reduced, limited, or modified, e.g., in an amount and/or direction of range of motion.

A range of motion of medial toe portion 271 and a range of motion of lateral toe portion 272 may be modified or controlled by controlling a configuration and construction of intermediate component 202 and other components of sole component 102. As shown in FIG. 9, in some embodiments intermediate component 202 may be formed as a thin plate of rigid material, e.g., composed of a carbon fiber and having a configuration including a protruding portion 240 and a slot 270, as discussed above. In some embodiments, upper component 204 may be formed as a thin plate or protective layer of material having a similar configuration including a protruding portion 230, as discussed above. In some embodiments base component 200 may be formed of a wear resistant material and having a similar configuration including a protruding portion 250, as discussed above. A composite structure including stacked, interfitted, or nested surface contours of protruding portion 230 (e.g., including portion 231), protruding portion 240 (e.g., including portion 241), and protruding portion 250 (e.g., including portion 251) may modify a rigidity (flexibility) characteristic and profile of sole structure 102 in toe region 103.

In some embodiments, bottom component 200 may have a thickness profile that facilitates control or modification of a rigidity characteristic and profile of intermediate component 202 and sole structure 102 at toe region 103, e.g., at the toe split. For example, in some embodiments bottom component 200 may have a thickness profile at toe region 103 that includes portions that are thicker, to increase localized rigidity (to reduce or limit flexibility) and portions that are thinner, to decrease localized rigidity (to increase or facilitate flexibility). As shown in FIGS. 1, 5, 6, and 9, in some embodiments bottom component 200 may include a thickened portion that forms a web 111 on bottom surface 216 of bottom component 200. In some embodiments, web 111 may be provided around at least a portion of a perimeter of element 241 of protruding portion 240 of intermediate component 202 (e.g., around at least a portion of a perimeter of corresponding element 251 of protruding portion 250 of base component 200). In some embodiments, web 111 may cover at least a portion of slot 270. As shown in FIGS. 1, 5, and 6, in some embodiments web 111 may be provided around an entire perimeter of element 241 of protruding portion 240 of intermediate component 202 and cover substantially an entirety of slot 270. As shown in FIG. 9, in some embodiments slot 270 of intermediate component 202 may have a width $W_{TS}$ 900 (see also 276 in FIG. 2), bottom component 200 generally may have a nominal thickness $T_B$ 901, and web 111 may have a width $W_W$ 902, an exposed height $H_W$ 904, and an overall thickness $T_W$ 905; it will be appreciated that one or more of these dimensions may be selected to modify or control a rigidity characteristic of medial toe portion 271 and lateral toe portion 272, e.g., to modify or control flexion relative to a centerline 910 of slot 270 of the toe split (see also centerline 320 of slot 270 in FIGS. 3 to 5). In some embodiments, web 111 may have a width $W_W$ 902, thickness $T_W$ 905 and thickness ratio $T_W$ 905/$T_B$ 901 selected to modify or control a desired range of motion (indicated by arrow 906; see also arrow 321 in FIGS. 3 to 5) of first or medial toe portion 271 and a range of motion (indicated by arrow 908; see also arrow 322 in FIGS. 3 to 5) of second or lateral toe portion 272. It will be appreciated that rigidity generally will increase as a thickness of web 111 increases; similarly rigidity generally will increase as a width of web 111 increases; similarly, rigidity generally will increase as a ratio $T_W$ 905/$T_B$ 901 increases.

A location of web 111 may modify a rigidity characteristic or profile of toe region 103 at the toe split. As shown in FIG. 9, in some embodiments a thickness profile of bottom component 200 may be configured so that web 111 and slot 270 have a common centerline 910. In some embodiments, however, a thickness profile of bottom component 200 may be configured so that a centerline of web 111 is offset from a centerline of slot 270. In this case, a range of motion or flexion of one of medial toe portion 271 and lateral toe portion 272 may be greater (e.g., more flexible) that a range of motion or flexion of the other one of medial toe portion 271 and lateral toe portion 272. In this manner, a desired rigidity (flexibility) characteristic or profile may be provided for sole structure 102 at toe region 103, e.g., at the toe split by controlling at least one of these dimensions or relative dimensions.

It will be appreciated that controlling a rigidity (flexibility) characteristic of sole structure 102 at the toe split may enable a user to achieve a desired performance characteristic. For example, controlling a rigidity (flexibility) characteristic of sole structure 102 at the toe split may enable control of linear acceleration of medial toe portion 271 during a toe off process portion of a stride, rotational acceleration about toe portion 271 when changing directions, sensitivity or touch characteristic for ball control (see, e.g., soccer ball 700 shown in dashed in lines in FIG. 7), or another performance characteristic of sole structure 102 and article of footwear 100.

A configuration of toe region 103 including a toe split and protruding portion at medial side 107 of toe region 103 may provide improved comfort and performance. As shown in FIG. 9, in some embodiments element 231 of protruding portion 230 of upper component 204, corresponding to element 241 of protruding portion 240 of intermediate component 202 located at medial side 107 of toe region 103, provides a top surface contour that is located below the top surface 211 of upper component 204 at lateral side 108 of toe region 103. It will be appreciated that, with this configuration, a big toe located on medial side 107 generally may be supported at a height or level below a height or level of toes located on lateral side 108. In some cases this configuration may provide a desired improvement in comfort and performance of sole structure 102 and article of footwear 100.

Forefoot Region Rigidity Features

In some embodiments, sole structure 102 may be configured to provide increased rigidity and support in forefoot region 104. In some embodiments, it may be desirable to provide increased rigidity and support across a portion or substantially an entirety of a lateral width of sole structure 102 and article of footwear 100, e.g., beneath the balls of the foot.

FIG. 10 illustrates an embodiment of sole structure 102 having increased rigidity and support at forefoot region 104, e.g., beneath the balls of the foot. As shown in FIG. 10, in some embodiments intermediate component 202 may be provided with element 242 of protruding portion 240 at forefoot region 104 having a surface contour configured to provide increased rigidity and support at forefoot region 104, e.g., beneath the balls of the foot. As shown in FIG. 10, in some embodiments upper component 206 similarly may include corresponding element 232 of protruding portion 230 having a surface contour configured to provide increased rigidity at forefoot region 104. As shown in FIG. 10, in some embodiments bottom component 200 similarly may include corresponding element 252 of protruding portion 250 having a surface contour configured to provide increased rigidity at forefoot region 104. As shown in FIGS. 2 and 10, with this configuration (including nested element 232, element 242, and element 252) chambered component 206 may include nested element 262 configured to provide a desired increased thickness or depth profile and associated rigidity and support in forefoot region 104, e.g., beneath the balls of the foot. In some embodiments, element 262 of chambered component 206 may be provided with a thickness profile having a greater or greatest thickness $T_{CC}$ 1002 at a location nested within element 232 of protruding portion 230, element 242 of protruding portion 240, and element 252 of protruding portion 250.

A construction and configuration of chambered component 206 further may modify or control a rigidity characteristic and support at forefoot region 104. In some embodiments, element 262 of chambered component 206 may be provided with a greater volume density (e.g., smaller pores or chambers and/or thicker chamber walls) within element 232 of protruding portion 230, element 242 of protruding portion 240, and element 252 of protruding portion 250. For example, as shown in FIGS. 2 and 10, in some embodiments element 262 of chambered component 206 may be provided with a solid or substantially solid volume within element 232 of protruding portion 230, element 242 of protruding portion 240, and element 252 of protruding portion 250. It will be appreciated that each of the above constructions may provide a desired increase in rigidity (e.g., planar rigidity) and support in forefoot region 104, e.g., below the balls of the foot.

In some embodiments, a configuration of components of sole structure 102 may facilitate modification and control of a rigidity characteristic of forefoot region 104. As shown in FIG. 10, in some embodiments bottom component 200 may have a thickness profile at forefoot region 104 that increases a thickness and associated rigidity of bottom component 200 and article of footwear 100. For example, a thickness $T_{BFF}$ 1004 of bottom component 200 beneath at least a portion of element 262 of chambered component 206 may be greater than a nominal thickness $T_B$ 901 of bottom component 200 (e.g., in adjacent portions of forefoot region 104). For example, in some embodiments bottom component 200 may have a thickness profile having an increased thickness that forms web 112 that extends laterally across a width of forefoot region 104 beneath element 262 of chambered component 206 (see also FIGS. 1, 5, and 6).

Forefoot Flex Zone Features

A configuration and associated rigidity profile (or flexibility profile) of sole structure 102 in forefoot region 104 may vary in different embodiments. In some embodiments, a configuration of sole structure 102 may be selected to have a rigidity or flexibility profile that provides at least one flex zone. For example, as shown in FIGS. 5, 7 and 8, in some embodiments a configuration of sole structure 102 may have a rigidity profile that provides a first flex zone 501 generally located between a first traction element group consisting of traction element 121, traction element 151, and traction element 152 and a second traction element group consisting of traction element 122, traction element 123, and traction element 124. As shown in FIGS. 5, 7, and 8, in some embodiments toe region 103 of sole structure 102 generally may flex about a plane 503 in flex zone 501, as indicated by arrow 701 in FIGS. 7 and 8. Similarly, as shown in FIGS. 5, 7, and 8, in some embodiments a configuration of sole structure 102 may have a rigidity provide that provides a second flex zone 502 generally located between the second traction element group consisting of traction element 122, traction element 123, and traction element 124 and a third traction element group consisting of traction element 131, traction element 132, and traction element 133. As shown in FIGS. 5, 7, and 8, in some embodiments forefoot region 104 of sole structure 102 generally may flex about a plane 504 in zone 502, e.g., as indicated by arrow 702 in FIGS. 7 and 8. It will be appreciated that the configuration of sole structure 102 in FIGS. 1 to 10 may include an increased rigidity characteristic in a portion of forefoot region 104 having an increased thickness and/or volume density of element 262 of chambered component 206 in forefoot region 104. It will be appreciated that in some embodiments flex zone 501 and flex zone 502 may be facilitated by a thickness profile of bottom component 200. For example, as discussed above, an increased rigidity of element 262 of chambered component 206 may be associated with an increased thickness profile of web 113 and the third group of traction elements of bottom component 200. Similarly, flex zone 501 may be associated with an increased thickness profile of web 111, web 112, and the second group of traction elements of bottom component 200. It will be appreciated that the configuration of FIGS. 1 to 10, including a thickness and rigidity profile provided by flex zone 501 and flex zone 502, may provide a flex characteristic or profile that is desirable for achieving various performance characteristics. For example, as shown in FIG. 7, in some embodiments this configuration and rigidity profile may provide a flex characteristic in forefoot region 104 that facilitates a desired sensitivity or feel of the article of footwear, e.g., for controlling a soccer ball 700 ("ball control").

Midfoot Region Rigidity Features

A construction and configuration of sole structure 102 may provide a desired asymmetric axis of torsional rigidity. A configuration of at least one component of sole structure 102, including a protruding portion of the component, may facilitate formation, location, and orientation of a desired asymmetric axis of torsional rigidity. A thickness profile of at least one component of sole structure 102 may facilitate formation, location, and orientation of a desired asymmetric axis of torsional rigidity.

A construction and configuration (including surface contours) of intermediate component 202 may form a desired asymmetric axis of torsional rigidity in sole structure 102. As shown in FIGS. 2 to 4, in some embodiments intermediate component 202 may have a protruding portion 240 including element portion 245 that extends diagonally (longitudinally and laterally) from lateral side 108 at heel region 106 through midfoot region 105 to medial side 107 at forefoot region 104. As best shown in FIGS. 2 and 3, in some embodiments element portion 245 of protruding portion 240 may form a continuous trough that extends diagonally from lateral side 108 at heel region 106 through midfoot region 105 to medial side 107 at forefoot region 104, and that has a continuous, generally linear medial edge that extends diagonally from lateral side 108 at heel region 106 through midfoot region 105 to medial side 107 at forefoot region 104. With this configuration, in some embodiments element portion 245 of protruding portion 240 may form an axis of torsional rigidity 310 in intermediate component 202 and sole structure 102 that extends along the trough of element portion 245, e.g., generally along the medial edge of element portion 245, as indicated by dashed line 310. Generally, portions of sole structure 102 on opposing sides of axis of torsional rigidity 310 have relative torsional flexibility about axis of torsional rigidity, e.g., as indicated by arrow 311 at forefoot region 104, and arrow 312 at heel region 106.

A construction and configuration of bottom component 200 may facilitate formation of a desired asymmetric axis of torsional rigidity in sole structure 102. As shown in FIGS. 2, 3, and 4, in some embodiments bottom component 200 may have a protruding portion 250 including element portion 255 that extends diagonally (longitudinally and laterally) from lateral side 108 at heel region 106 through midfoot region 105 to medial side 107 at forefoot region 104. As best shown in FIGS. 2 and 3, in some embodiments element portion 255 of protruding portion 250 may form a continuous, generally linear trough that extends diagonally from lateral side 108 at heel region 106 through midfoot region 105 to medial side 107 at forefoot region 104, and that has a continuous, generally linear medial edge that extends diagonally from lateral side 108 at heel region 106 through midfoot region 105 to medial side 107 at forefoot region 104. With this configuration, in some embodiments element portion 255 of protruding portion 250 may facilitate formation of axis of torsional rigidity 310 in bottom component 200 and sole structure 102 that extends along the trough of element portion 255, e.g., generally along the medial edge of element portion 255, as indicated by dashed line 310, arrow 311 at forefoot region 104, and arrow 312 at heel region 106.

A construction and configuration of optional upper component 204 may facilitate formation of a desired asymmetric axis of torsional rigidity in sole structure 102. As shown in FIGS. 2, 3, and 4, in some embodiments upper component 204 may have a protruding portion 230 including element portion 235 that extends diagonally (longitudinally and laterally) from lateral side 108 at heel region 106 through midfoot region 105 to medial side 107 at forefoot region 104. As best shown in FIGS. 2 and 3, in some embodiments element portion 235 of protruding portion 230 may form a continuous, generally linear trough that extends diagonally from lateral side 108 at heel region 106 through midfoot region 105 to medial side 107 at forefoot region 104, and that has a continuous, generally linear medial edge that extends diagonally from lateral side 108 at heel region 106 through midfoot region 105 to medial side 107 at forefoot region 104. With this configuration, in some embodiments element portion 235 of protruding portion 230 may facilitate formation of axis of torsional rigidity 310 in upper component 204 and sole component 102 that generally extends along a medial edge of element 235, as indicated by dashed line 310, arrow 311 at forefoot region 104, and arrow 312 at heel region 106.

A construction and configuration of sole structure 102 in midfoot region 105 may provide a desired rigidity profile in midfoot region 105 that facilitates forming an asymmetric axis of torsional rigidity. A construction and configuration of components of sole structure 102 in midfoot region 105 may provide a desired rigidity profile in midfoot region 105 that facilitates formation of an asymmetric axis of torsional rotation.

A configuration of protruding portion 240 of intermediate component 202 in midfoot region 105 may provide a desired rigidity profile in midfoot region 105 that facilitates forming an asymmetric axis of torsional rigidity. As shown in FIG. 2, in some embodiments element 243 in midfoot region 105 of intermediate component 202 may be Y-shaped. Further, as shown in FIG. 2, in some embodiments element portion 245 and element portion 246 of element 243 in midfoot region 105 and element 242 in forefoot region 104 may combine to form a continuous trough having a triangular shape and defining a raised central portion 247. It will be appreciated that this configuration of surface contours of protruding portion 240 may provide a desired planar rigidity characteristic in midfoot region 105 of intermediate component 202 and sole structure 102 that facilitates formation of axis of torsional rigidity 310.

A configuration of protruding portion 250 of bottom component 200 in midfoot region 105 may provide a desired rigidity profile in midfoot region 105 that facilitates forming an asymmetric axis of torsional rigidity. As shown in FIG. 2, in some embodiments element 253 in midfoot region 105 of bottom component 202 may be Y-shaped. Further, as shown in FIG. 2, in some embodiments element portion 255 and element portion 256 of element 253 in midfoot region 105 and element 252 in forefoot region 104 may combine to form a continuous trough having a triangular shape and defining a raised central portion 257. It will be appreciated that this configuration of surface contours of protruding portion 250 may provide a desired planar rigidity characteristic in midfoot region 105 of bottom component 202 and sole structure 102 that facilitates formation of axis of torsional rigidity 310.

Similarly, a configuration of protruding portion 230 of optional upper component 204 in midfoot region 105 may provide a desired rigidity profile in midfoot region 105 that facilitates forming an asymmetric axis of torsional rigidity. As shown in FIG. 2, in some embodiments element 233 in midfoot region 105 of bottom component 204 may be Y-shaped. Further, as shown in FIG. 2, in some embodiments element portion 245 and element portion 246 of element 243 in midfoot region 105 and element 242 in forefoot region 104 may combine to form a continuous trough having a triangular shape and defining a raised central portion 237. It will be appreciated that this configuration of surface contours of protruding portion 230 may provide a desired planar rigidity characteristic in midfoot region 105 of upper component 204 and sole structure 102 that facilitates formation of axis of torsional rigidity 310.

A construction and configuration of optional chambered component 206 may facilitate formation of a desired asymmetric axis of torsional rigidity in sole structure 102. A construction and configuration of chambered component 206 may help provide sole structure 102 with a desired rigidity profile that facilitates formation of a desired asymmetric axis of torsional rigidity in sole structure 102.

A construction and configuration of chambered component 206 may provide a desired lateral rigidity profile in forefoot region 104 that facilitates forming an asymmetric axis of torsional rigidity. As shown in FIGS. 2, 3, and 4, in some embodiments chambered component 206 may include an element portion 265 that extends diagonally (longitudinally and laterally) from lateral side 108 at heel region 106 through midfoot region 105 to medial side 107 at forefoot region 104. As best shown in FIGS. 2 and 3, in some embodiments element portion 265 of chambered component 206 may form a continuous, substantially linear body that extends diagonally from lateral side 108 at heel region 106 through midfoot region 105 to medial side 107 at forefoot region 104. With this configuration, in some embodiments element portion 265 of chambered component 206 may facilitate formation of axis of torsional rigidity 310 in intermediate component 202, bottom component 200, and optional upper component 204 that generally extends along a medial edge of element 265, as indicated by dashed line 310, arrow 311 at forefoot region 104, and arrow 312 at heel region 106.

As shown in FIGS. 2 to 4 and 10 to 14, chambered component 206 may provide selected regions of increased rigidity in sole structure 102. For example, as shown in FIGS. 2, 3, 4, and 10, in some embodiments chambered component 206 may have an increased rigidity in substantially an entire lateral width of forefoot region 104 formed by element portion 262. In some embodiments, element portion 262 may have an increased thickness. In some embodiments, element portion 262 may have an increased volume density. In some embodiments, element portion 262 may have a solid or substantially solid construction. In each embodiment, it will be appreciated that an increased rigidity at element portion 262 across substantially an entire lateral width of forefoot region 104 of sole structure may facilitate forming axis of torsional rigidity 310.

A construction and configuration of chambered component 206 in forefoot region 104 and midfoot region 105 may facilitate a desired lateral rigidity in midfoot region 105 that facilitates forming an asymmetric axis of torsional rigidity. As shown in FIGS. 2 to 4 and 11 to 13, in some embodiments chambered component 206 generally may have a Y-shaped element 263 in midfoot region 105. Y-shaped element 263 generally may include element portion 265 that extends from lateral side 108 at heel region 106 through midfoot region 105 to medial side 107 in forefoot region 104, and element portion 266 that extends along lateral side 108 from midfoot region 105 to forefoot region 104.

A nested configuration of components of sole structure 102 may provide a desired rigidity profile in midfoot region 105 that facilitates forming an asymmetric axis of torsional rigidity. FIG. 11 is a cross-sectional view of sole structure 102 in midfoot region 105 taken along section line 11-11 of FIG. 5, and FIG. 12 is a perspective view of midfoot region 105 and heel region 106 of sole structure 102 as viewed from section line 11-11 of FIG. 5 and the cross-sectional view of FIG. 11. As shown in FIGS. 11 and 12, in some embodiments sole structure 102 may have a nested structure including element 266 of chambered component 206, element portion 236 of upper component 204, and element portion 246 of intermediate component 202 stacked on element portion 256 of bottom component 206 at lateral side 108 of midfoot region 105. Sole structure 102 may have a nested structure including raised central element 237 of upper component 204 and raised central element 247 of intermediate component 202 stacked on raised central element 257 of bottom component 200 in a central region of midfoot region 105. And sole structure 102 may have a nested structure including element 265 of chambered component 206, element portion 235 of upper component 204, element portion 245 of intermediate component 202 stacked on element portion 255 of bottom component 206 at lateral side 108. It will be appreciated that this nested structure may provide a desired planar rigidity profile at lateral side 108 of midfoot region 105 that facilitates formation of an asymmetric axis of torsional rigidity, generally indicated as dashed line 1110, where sole structure 102 may have a direction of torsional flexion generally indicated by arrow 1111 and arrow 1112. Similarly, FIG. 13 is a cross-sectional view of sole structure 102 in midfoot region 105 taken along section line 13-13 of FIG. 5. As shown in FIG. 13, in some embodiments sole structure 102 may have a nested structure including element 264 of chambered component 206, element portion 234 of upper component 204, and element portion 244 of intermediate component 202 stacked on element 254 of bottom component 206 at lateral side 108 of midfoot region 105. It will be appreciated that this nested structure may provide a desired planar rigidity profile at lateral side 108 of midfoot region 105 that facilitates an asymmetric axis of torsional rigidity, generally indicated as dashed line 1310, where sole structure 102 may have a direction of torsional flexion generally indicated by arrow 1311 and arrow 1312. It will be appreciated that, in some embodiments asymmetric axis of torsional rigidity 1110 and asymmetric axis of torsional rigidity 1310 may correspond to asymmetric axis of torsional rigidity 311, direction of torsional flexion arrow 1211 and direction of torsional flexion arrow 1112 may correspond to direction of torsional flexion arrow 311 and direction of flexion arrow 312, respectively.

A thickness profile of bottom component 206 may provide a desired rigidity profile in midfoot region 105 that facilitates forming an asymmetric axis of torsional rigidity. As shown in FIGS. 11 and 12, in some embodiments a thickness profile of bottom component 206 may include a nominal thickness $T_B$ 1120, and an increased thickness $T_R$ 1122 that forms ridge 110 located beneath element portion 255 of bottom component 206 at medial side 107 of midfoot region 105 adjacent forefoot region 104. Similarly, as shown in FIG. 13, in some embodiments a thickness profile of bottom component 206 may include a nominal thickness $T_B$ 1320 and an increased thickness $T_R$ 1322 that forms ridge 110 located beneath element 255 of bottom component 206 at lateral side 108 of midfoot region 105 adjacent heel region 106. It will be appreciated that, in some embodiments asymmetric axis of torsional rigidity 1310 may correspond to asymmetric axis of torsional rigidity 311, direction of torsional flexion arrow 1311 and direction of torsional flexion arrow 1312 may correspond to direction of torsional flexion arrow 311 and direction of flexion arrow 312, respectively. As shown in FIG. 13, in some embodiments asymmetric axis of rigidity 1310 (310) may be offset from a centerline 1331 of element 233 of protruding portion 230, element 243 of protruding portion 240, and element 253 of protruding portion 250 of sole structure 102, e.g., a lateral edge of the trough, e.g., by a distance $D_{OFF}$ 1322.

Heel Region Rigidity Features

A construction and configuration of components of sole structure 102 may provide a desired planar rigidity profile in heel region 106 that facilitates stable support of a heel in heel region 106 and formation of an asymmetric axis of torsional rigidity. FIG. 14 is a cross-sectional view of sole structure 102 taken along section line 14-14 of FIG. 5. As shown in FIGS. 2 and 3, in some embodiments element 264 of chambered component 206 may be configured to curve around from lateral side 108 of heel region 106 to medial side 107 of heel region 106 and terminate at element portion 268 at medial side 107 of heel region 106. As shown in FIG. 14, in some embodiments element 264 of chambered component 206, element 234 of upper component 204, and element 244 of intermediate component 202 may be stacked and/or nested in element 254 of bottom component 200. As shown in FIGS. 1, 6, 12, and 14, in some embodiments bottom component 200 may have a thickness profile that forms traction element 141, traction element 142, traction element 143, and traction element 144 (blade cleats), with common blade member 172 bridging traction element 141 and traction element 142 on medial side 107, and common blade member 173 bridging traction element 143 and traction element 144 on lateral side 108 (see FIG. 14). As shown in FIG. 14, bottom component 200, intermediate component 202, and upper component 204 also may be provided with respective surface contours that form a peripheral lip that curves upward. It will be appreciated that this configuration may provide a heel cup for comfortably and securely supporting a heel during use of sole structure 102 and article of footwear 100.

A configuration of protruding portion 240 of intermediate component 202 may form a desired rigidity profile in midfoot region 105 and heel region 106 that facilitates formation of an asymmetric axis of torsional rigidity. As shown in FIGS. 1, 3, and 12, in some embodiments element 244 at midfoot region 105 and heel region 106 of intermediate component 202 may have an arched shape that follows a perimeter of heel region 106 and terminates in element portion 238 at medial side 107. As shown in FIGS. 2, 3, 12, and 13, in some embodiments element 244 (including element portion 248) may form a raised central portion 249 in midfoot region 105 and heel region 106 of intermediate component 202. It will be appreciated that this configuration of intermediate component 202, including surface contours of protruding portion 240 in midfoot region 105 and heel region 106, may provide a desired rigidity characteristic and profile in midfoot region 105 and heel region 106, e.g., a desired planar rigidity that facilitates formation of asymmetric axis of torsional rigidity 1110 (310) in intermediate component 202 and sole structure 102.

Similarly, a configuration of protruding portion 250 of bottom component 200 may form a desired rigidity profile in midfoot region 105 and heel region 106 that facilitates formation of an asymmetric axis of torsional rigidity. As shown in FIGS. 1, 3, and 12, in some embodiments element 254 at midfoot region 105 and heel region 106 of bottom component 202 may have an arched shape that follows a perimeter of heel region 106 and terminates in element portion 258 at medial side 107. As shown in FIGS. 2, 3, 12, and 13, in some embodiments element 254 (including element portion 258) may form a raised central portion 259 in midfoot region 105 and heel region 106 of bottom component 200. It will be appreciated that this configuration of bottom component 200, including surface contours of protruding portion 250 in midfoot region 105 and heel region 106, may provide a desired rigidity characteristic and profile in midfoot region 105 and heel region 106, e.g., a desired planar rigidity that facilitates formation of asymmetric axis of torsional rigidity 310 (1110 and 1310) in bottom component 200 and sole structure 102.

Similarly, a configuration of protruding portion 230 of upper component 204 may form a desired rigidity profile in midfoot region 105 and heel region 106 that facilitates formation of an asymmetric axis of torsional rigidity. As shown in FIGS. 1, 3, and 12, in some embodiments element 234 at midfoot region 105 and heel region 106 of upper component 204 may have an arched shape that follows a perimeter of heel region 106 and terminate in element portion 238 at medial side 107. As shown in FIGS. 2, 3, 12, and 13, in some embodiments element 234 (including element portion 238) may form a raised central portion 239 in midfoot region 105 and heel region 106 of upper component 204. It will be appreciated that this configuration of upper component 204, including surface contours of protruding portion 230 in midfoot region 105 and heel region 106, may provide a desired rigidity characteristic and profile in midfoot region 105 and heel region 106, e.g., a desired planar rigidity that facilitates formation of asymmetric axis of torsional rigidity 310 (1110 and 1310) in upper component 204 and sole structure 102.

A configuration of chambered component 206 may provide a desired rigidity profile in midfoot region 105 and heel region 106 that facilitates forming an asymmetric axis of torsional rigidity. As shown in FIGS. 2, 3, and 12, in some embodiments element 264 in midfoot region 105 and heel region 106 may have an arched shape that follows a perimeter of heel region 106 and terminates in element portion 268 at medial side 107. As shown in FIGS. 2, 3, 5, 12, and 13, in some embodiments element 264 (including element portion 268) surrounds raised central portion 249 of intermediate component 202, raised central portion 259 of bottom component 200, and raised central portion 239 of upper component 204. It will be appreciated that this configuration of chambered component 206 may provide a desired rigidity characteristic and profile in midfoot region 105 and heel region 106, e.g., a desired planar rigidity that facilitates formation of asymmetric axis of torsional rigidity 310 (1110 and 1310) in sole structure 102.

Component Composition

A material composition of one or more components of sole structure 102 can vary in different embodiments. For example, in different embodiments upper component 204, chambered component 206, intermediate component 202, and bottom component 200 may be made of a variety of different materials that provide for a lightweight and selectively rigid, yet flexible, sole structure 102 having a desired planar and/or torsional rigidity characteristic.

Upper component 204 may be formed from a variety of materials in different embodiments. Generally, materials used with upper component 204 can be selected to achieve a desired rigidity, flexibility, or other desired characteristic for upper component 204 and sole structure 102. In some embodiments, upper component 204 may be formed from a weave and/or mesh of glass fibers, fiberglass, fiberglass composite and/or glass-reinforced plastic. In some embodiments, the weave or mesh may be anodized or coated with one or more alloy(s) or metal(s), like silver. In some embodiments, upper component 204 may be formed from carbon, carbon fiber, carbon composite, and/or recycled or reground carbon materials. In some embodiments, upper component 204 may be made of layers including fibers that are oriented in an alternating orientation, such as an alternating 0°/90° orientation and/or an alternating 45°/45° orientation. In some embodiments, upper component 204 may be formed from thermoplastic polyurethanes, recycled thermoplastic polyurethane, and/or composite including thermoplastic polyurethane. In some embodiments, upper component 204 may include a layer, or partial layer, of thermoplastic polyurethane on one of the surfaces in order to protect the entire sole structure 102 from impact forces from the wearer's foot. In some embodiments, any combination of materials known to those skilled in the art or later developed may be used to form upper component 204. In some embodiments, upper component 204 may be made of fiberglass and/or fiberglass composite.

Chambered component 206 may be formed from a variety of materials. In some embodiments, chambered component 206 may be formed from a weave and/or mesh of glass fibers, fiberglass, fiberglass composite and/or glass-reinforced plastic. In some embodiments, the weave or mesh may be anodized or coated with one or more alloy(s) or metal(s), like silver. In some embodiments, chambered component 206 may be formed from carbon, carbon fiber, carbon composite, and/or recycled or reground carbon materials. In some embodiments, chambered component 206 may be made of layers including fibers that are oriented in an alternating 0°/90° orientation and/or an alternating 45°/45° orientation. In some embodiments, chambered component 206 may be formed from thermoplastic polyurethanes, recycled thermoplastic polyurethane, and/or composite including thermoplastic polyurethane. In some embodiments, any combination of materials known to those skilled in the art or later developed may be used to form chambered component 206. In some embodiments, chambered component 206 may be made of a carbon and/or carbon composite.

Intermediate component 202 may be formed from a variety of materials in different embodiments. In some embodiments, intermediate component 202 may be formed from a weave and/or mesh of glass fibers, fiberglass, fiberglass composite and/or glass-reinforced plastic. In some embodiments, the weave or mesh may be anodized or coated with one or more alloy(s) or metal(s), like silver. In some embodiments, intermediate component 202 may be formed from carbon, carbon fiber, carbon composite, and/or recycled or reground carbon materials. In some embodiments, intermediate component 202 may be made of layers including fibers that are oriented in an alternating orientation, such as an alternating 0°/90° orientation and/or an alternating 45°/45° orientation. In some embodiments, intermediate component 202 may be formed from thermoplastic polyurethanes, recycled thermoplastic polyurethane, and/or composite including thermoplastic polyurethane. In some embodiments, any combination of materials known to those skilled in the art or later developed may be used to form intermediate component 202 having an appropriate stiffness or hardness. In some embodiments, intermediate component 202 may be made from carbon fiber.

Bottom component 200 may be formed from a variety of materials in different embodiments. In some embodiments, bottom component 200 may be formed from a plastic. In some embodiments, any combination of materials known to those skilled in the art or later developed may be used to form bottom component 200. For example, in some embodiments bottom component 200 may be made from a mixture of the same material or materials that are used to make one or more of upper component 204, intermediate component 202, and/or chambered component 206.

Upper component 204, chambered component 206, intermediate component 202, and/or bottom component 200 may be formed in any manner, e.g., using a variety of processes, in different embodiments. In some embodiments, each component may be molded or formed into a desired preformed shape in a separate molding process and then the components may be assembled and/or joined together in a further process, e.g., a further molding or bonding process. In some embodiments, edges of any molded component may be trimmed using any means known to those skilled in the art or later developed, including a water jet or laser process. In some embodiments, one or more components may be molded in a common molding process. For example, in some embodiments chambered component 206 and upper component 204 may be molded as a single component in a single common molding process. In some embodiments, upper component 204 and bottom component 200 may be molded in a single molding process, e.g., in a molding process that encapsulates intermediate component 202.

Components shown in FIGS. 1 and 2 may be bonded or attached to one another in different embodiments using any of a variety of methods. In some embodiments, heat and/or pressure may be applied to the various components in order bond them together. For example, a heat pressing process may be used to bond upper component 204 to bottom component 200. In another example, a heat pressing process may be used to bond intermediate component 202 to bottom component 200. In some embodiments, thermoplastic polyurethane may be used to bond the components to one another. In some embodiments, any form of adhesive known to those skilled in the art or later developed may be used to bond the components together. In some embodiments, other methods of bonding the components known to those skilled in the art or later developed may be used. In some embodiments, upper component 204 and intermediate component 202 may be placed in a mold and chambered component 206 may be injected into a concave contour of protruding portion 220 of upper component 204 or protruding portion 230 of intermediate component 202.

Other Embodiments

A configuration of sole structure 102 may vary in different embodiments. For example, a configuration of sole structure 102 may vary based on an intended ground surface for article of footwear 100. In particular, a cleat configuration and/or thickness profile of sole structure 102 may vary based on an intended ground surface for article of footwear 100, such as natural turf, artificial turf, sand, or other types of ground surfaces.

Figure 15:
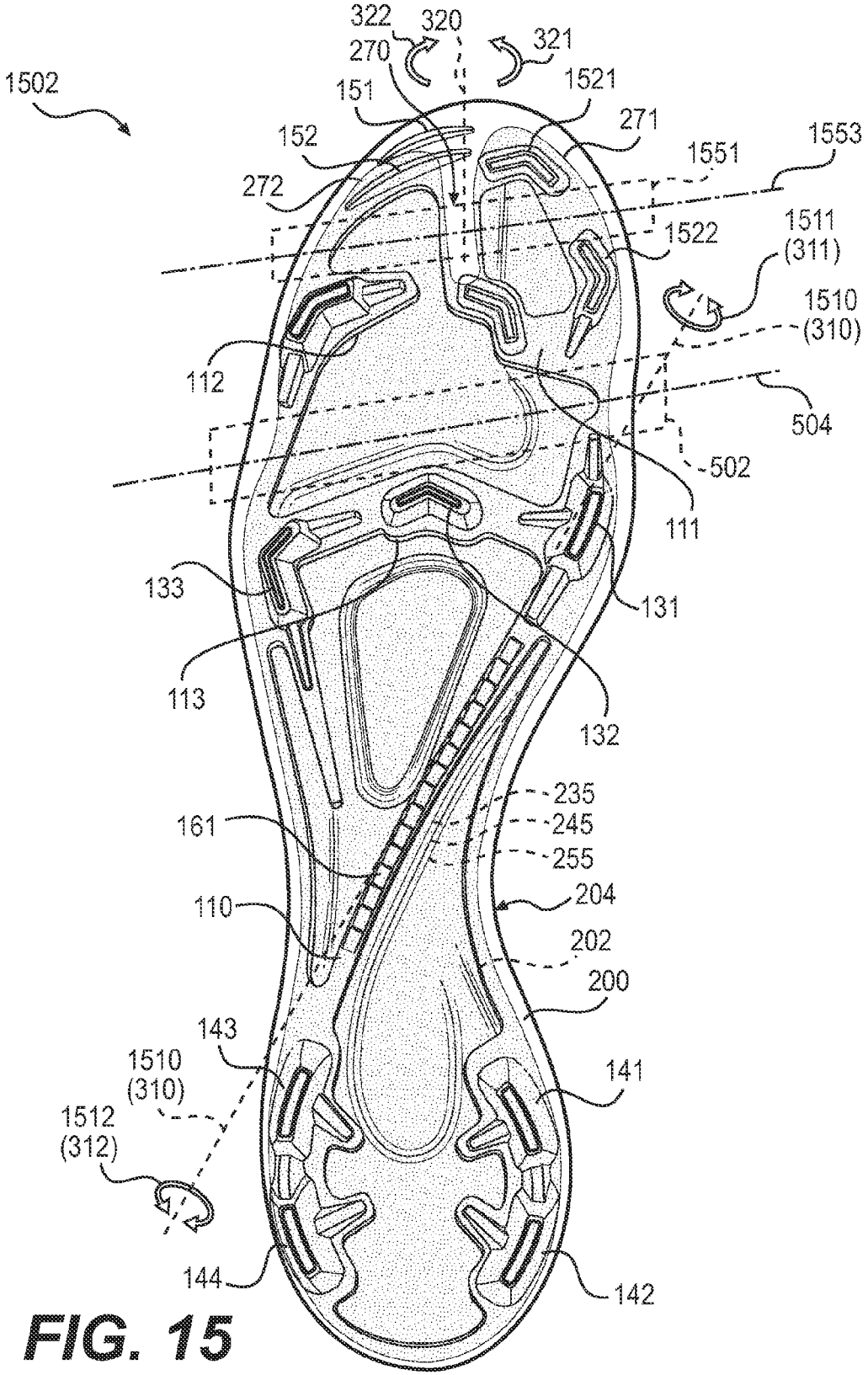
FIG. 15 is a bottom plan view of another embodiment of a sole structure of the article of footwear of FIGS. 1 and 2.

FIG. 15 illustrates another embodiment of an assembled sole structure 1502 that may be suitable for a particular ground surface, such as artificial turf. Sole structure 1502 generally corresponds to sole structure 102 for article of footwear 100 in FIGS. 1 and 2. Sole structure 1502 generally is substantially similar in composition and construction to sole structure 102. For example, in some embodiments sole structure 1502 generally may include bottom component 200, intermediate component 202, optional upper component 204, and optional chambered component 206, as illustrated in FIG. 2. As shown in FIG. 15, in some embodiments bottom component 200 of sole structure 1502 may have a configuration that is substantially similar to the configuration of bottom component 200 of sole structure 102. For example, as shown in FIG. 15, in some embodiments bottom component 200 of sole structure 1502 may have a thickness profile that is substantially similar to the thickness profile of bottom component 200 of sole structure 102.

Sole structure 1502 may have a construction and configuration providing an asymmetric torsional rigidity and flex characteristics that are substantially similar to asymmetric torsional rigidity and flex characteristics of sole structure 102. Specifically, a construction and configuration of sole structure 1502 may include a trough formed by element 245 of protruding portion 240 of intermediate component 202, element 255 of protruding portion 250 of bottom component 200, and element 235 of protruding portion 230 of optional upper component 204, and bottom component 200 may have a thickness profile that forms a ridge 110 on bottom surface 216 of bottom component 200 that extends substantially along the trough. Accordingly, in some embodiments sole structure 1502 may provide an asymmetrical axis of torsional rigidity 1510 that extends substantially along ridge 110 of bottom component 200, and substantially corresponding with a medial edge of the trough formed by element 245 of protruding portion 240 of intermediate component 202, element 255 of protruding portion 250 of bottom component 200, and element 235 of protruding portion 230 of optional upper component 204. Thus, it will be appreciated that, as shown in FIG. 15, in some embodiments axis of torsional rigidity 1510 may correspond to axis of torsional rigidity 310 of sole structure 102.

As shown in FIG. 15, in some embodiments bottom component 200 of sole structure 1502 may have a thickness profile and traction element configuration at medial side 107 of toe region 103 that is different from bottom component 200 of sole structure 200 of FIGS. 1 and 2. For example, sole structure 1502 also may have a different configuration of traction elements at medial side 107 in toe region 103. As shown in FIG. 15, in some embodiments bottom component 200 of sole structure 1502 may include a first traction element 1521, a second traction element 1522, and a third traction element 1523 at medial side 107 of toe region 103, a fourth traction element 1524 at lateral side 108 of toe region 103. As shown in FIG. 15, however, in some embodiments each of traction element 1521, traction element 1522, and traction element 1523 may have a chevron-shaped blade member and form a chevron-shaped cleat member. Also, as opposed to the embodiment of FIGS. 1 and 2, in which each of traction element 121, traction element 122, and traction element 123 is arched in a direction away from one another around web 111 (i.e., radially outward from a central region of elements forming a toe depression), as shown in FIG. 15, in some embodiments at least one traction element may be arranged to arch inward (see, e.g., traction element 1523 that is arranged to arch radially inward toward a central region of web 111 of medial toe portion 271). It will be appreciated that varying a configuration of traction elements at toe region 103 may provide a desired traction characteristic for medial toe portion 271 and sole structure 1502 that is different from a traction characteristic for medial toe portion 271 of sole structure 102.

A location and function of flex zones in the forefoot region of sole structure 1502 may be substantially similar to flex zones in the forefoot region of sole structure 102. As shown in FIG. 15, in some embodiments traction element 1521 and traction element 1522 do not share a common buttress support structure (compare with common buttress of traction element 121 and traction element 122 of sole structure 102 in FIG. 5). Accordingly, a rigidity characteristic of flex zone 1551, e.g., for flexion of forefoot region 104 about axis line 1553, may be less than a rigidity characteristic of flex zone 501 of sole structure 102. In some embodiments, sole structure 1502 may have substantially the same construction and configuration as sole structure 102 of FIG. 5 at flex zone 502, and may have substantially similar flexion of forefoot region 104 about axis line 503. Those skilled in the art will be able to select a construction and configuration of sole structure 1502 suitable for achieving a desired flex characteristic for sole structure 1502 in forefoot region 104.

Figure 16:
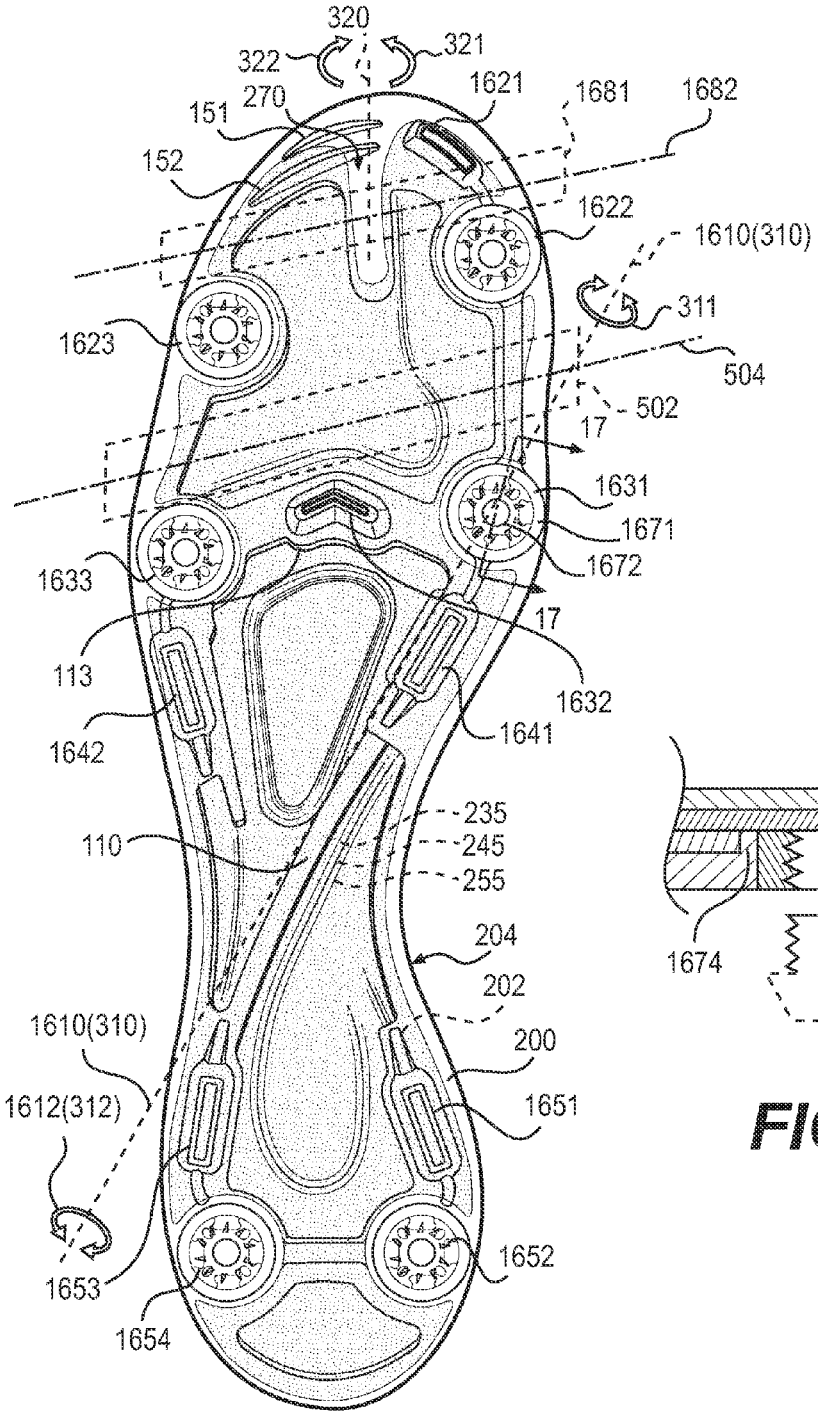
FIG. 16 is a bottom plan view of a further embodiment of a sole structure of the article of footwear of FIGS. 1 and 2.

FIG. 16 illustrates another embodiment of an assembled sole structure 1602 that may be suitable for a different ground surface, such as natural turf. Sole structure 1602 generally corresponds to sole structure 102 for article of footwear 100 in FIGS. 1 and 2. Sole structure 1602 may be substantially similar in composition and construction to sole structure 102. For example, in some embodiments sole structure 1602 generally may include bottom component 200, intermediate component 202, optional upper component 204, and optional chambered component 206, as illustrated in FIG. 2. As shown in FIG. 16, in some embodiments bottom component 200 of sole structure 1602 may have a configuration that is substantially similar to the configuration of bottom component 200 of sole structure 102. As shown in FIG. 16, in some embodiments bottom component 200 of sole structure 1602 may have a thickness profile that is substantially similar to the thickness profile of bottom component 200 of sole structure 102.

Sole structure 1602 may have a construction and configuration providing a torsional rigidity and flex characteristics that are substantially similar to a torsional rigidity and flex characteristics of sole structure 102. Specifically, a construction and configuration of sole structure 1602 may include a trough formed by element 245 of protruding portion 230 of intermediate component 202, element 255 of protruding portion 240 of bottom component 200, and element 235 of protruding portion 220 of optional upper component 204, and bottom component 200 may have a thickness profile that forms a ridge 110 on bottom surface 216 of bottom component 200 that extends substantially along the trough. Accordingly, in some embodiments sole structure 1602 may provide an asymmetrical axis of torsional flex 1610 that extends substantially along ridge 110 of bottom component 200, and substantially corresponding with an edge of the trough formed by element 245 of protruding portion 230 of intermediate component 202, element 255 of protruding portion 240 of bottom component 200, and element 235 of protruding portion 220 of optional upper component 204. Thus, it will be appreciated that, as shown in FIG. 16, in some embodiments axis of torsional rigidity 1610 may correspond to axis of torsional rigidity 310 of sole structure 102.

As shown in FIG. 16, in some embodiments bottom component 200 of sole structure 1602 may have a thickness profile and traction element configuration that is different from bottom component 200 of sole structure 200 of FIGS. 1 and 2. For example, sole structure 1602 may have a different type and configuration of traction elements.

A number, type, and arrangement of traction elements of sole structure 1602 may vary in different embodiments. As shown in FIG. 16, in some embodiments bottom component 200 of sole structure 1602 may include a first traction element 1621 and a second traction element 1622 located at medial side 107 of toe region 103, a third traction element 1623 located at lateral side 108 of toe region 103, a fourth traction element 1631 located at medial side 107 of forefoot region 104, a fifth traction element 1632 located at a central region of forefoot region 104, a sixth traction element 1633 located at lateral side 108 of forefoot region 104, a seventh traction element 1641 located at medial side 107 of midfoot region 105, an eighth traction element 1642 located at lateral side 108 of midfoot region 105, a ninth traction element 1651 and a tenth traction element (rear medial traction element) 1652 located at medial side 107 of heel region 106, and a eleventh traction element 1653 and a twelfth traction element (rear lateral traction element) 1654) located at lateral side 108 of heel region 106.

As shown in FIG. 16, in some embodiments (e.g., traction element 1621, traction element 1641, traction element 1642, traction element 1651, and traction element 1653), a traction element may take the form of a blade cleat. Each of these traction elements (blade cleats) may have a structure and configuration substantially similar to traction elements (blade cleats) as discussed above with respect to sole structure 102. In some embodiments, traction element 1641 and traction element 1642 located in midfoot region 105 and traction element 1651 and traction element 1652 located in heel region 106 variously may cooperate to contact and provide traction relative to a soccer ball located under sole structure 1602 at midfoot region 105, i.e., to facilitate ball control.

Figure 17:
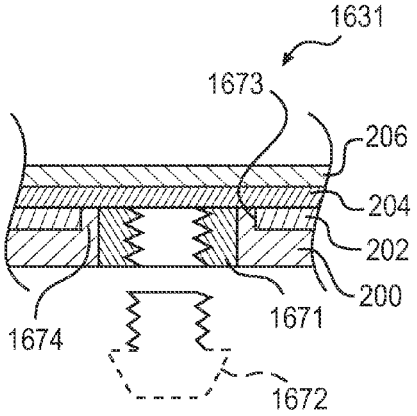
FIG. 17 is an enlarged cross-sectional view of an embodiment of a cleat seat assembly of the sole structure of FIG. 16 taken along section line 17-17 of FIG. 16.

As shown in FIG. 16, in some embodiments (e.g., traction element 1622, traction element 1623, traction element 1631, traction element 1633, traction element 1652, and traction element 1654), a traction element may take the form of threaded cleat. FIG. 17 is an enlarged cross-sectional view of a traction element (threaded cleat) taken along section line 17-17 in FIG. 16. As shown in FIGS. 16 and 17, in some embodiments bottom component 200 may include a threaded base element 1671 for receiving a threaded cleat element 1672 to form traction element (threaded cleat) 1631. As shown in FIGS. 16 and 17, in some embodiments intermediate component 202 may include a cut-out portion 1673 that is configured (sized) to receive threaded base element 1671. As shown in FIGS. 16 and 17, in some embodiments cut-out portion 1673 may have a generally circular configured sized to receive a portion of bottom component 200, which may form an annular web 1674 located adjacent upper component 204.

A construction and configuration of toe region 103 of sole structure 1602 may be substantially similar to sole structure 102. A construction and configuration of the toe split may be substantially similar. A construction of intermediate component 202 at the toe split (e.g., slot 270) may be substantially similar to sole structure 102. As shown in FIG. 16, a configuration, including at least a thickness profile of bottom component 200, may be different in sole structure 1602. For example, as shown in FIG. 16, in some embodiments web 111 in toe region 103 may cover only a portion of a perimeter of medial toe portion 271; as shown in FIG. 16, in some embodiments web 111 may cover an entirety of slot 270. Accordingly, it will be appreciated that this construction and configuration of sole structure 1602 may control rigidity and flex characteristics of sole structure 1602 at toe region 103, e.g., at the toe split, in a manner substantially similar to sole structure 102.

A location and function of flex zones in forefoot region 104 of sole structure 1602 may be substantially similar to flex zones in the forefoot region of sole structure 102. As shown in FIG. 16, in some embodiments no traction element is located in toe region 103 adjacent slot 270 of sole structure 1602 (compare with traction element 123 of FIGS. 1 and 5, and traction element 1523 in FIG. 15). Accordingly, a rigidity characteristic of flex zone 1681, e.g., for flexion of forefoot region 104 about axis line 1682, may be different than (e.g., less than) a rigidity characteristic of flex zone 501 of sole structure 102 in FIGS. 1 and 5, and/or a rigidity characteristic of flex zone 1551 of sole structure 102 in FIG. 15. In some embodiments, sole structure 1602 may have a substantially similar construction and configuration as sole structure 102 of FIG. 5 at flex zone 502, and may have substantially similar flexion of forefoot region 104 at flex zone 502, e.g., about axis line 504. Those skilled in the art will be able to select a construction and configuration of sole structure 1602 suitable for achieving a desired flex characteristic for sole structure 1602 in forefoot region 104.

While various embodiments of the have been described, the description is intended to be exemplary, rather than limiting and it will be apparent to those of ordinary skill in the art that many more embodiments and implementations are possible that are within the scope of the current embodiments. Accordingly, the embodiments are not to be restricted except in light of the attached claims and their equivalents. Also, various modifications and changes may be made within the scope of the attached claims.

What is claimed is:

1. A sole structure for an article of footwear having an upper, the sole structure comprising:

a bottom component having a ground-contacting surface; and a chambered component disposed between the bottom component and the upper and including a first portion extending along a medial side of the sole structure, a second portion extending along a lateral side of the sole structure, and a third portion extending from a junction of the first portion and the second portion and including a first segment extending in a first direction along the lateral side of the sole structure and toward a heel region, a second segment extending from the first segment and along the heel region, and a third segment extending in a second direction opposite the first direction from the second segment along the medial side to a terminal end that is spaced apart from and opposes one of the first portion and the second portion to form a discontinuity between the terminal end and the one of the first portion and the second portion.

2. The sole structure of claim 1, wherein the chambered component includes a plurality of chambers defined by walls extending from a first surface of the chambered component.

3. The sole structure of claim 2, wherein the plurality of chambers are disposed between the first surface and the upper.

4. The sole structure of claim 2, wherein the plurality of chambers include a pattern of adjacent polygons.

5. The sole structure of claim 2, wherein the chambered component includes a continuous surface disposed adjacent to the plurality of chambers.

6. The sole structure of claim 5, wherein the continuous surface is disposed in a forefoot region of the sole structure.

7. The sole structure of claim 1, further comprising an intermediate component disposed between the chambered component and the bottom component.

8. The sole structure of claim 7, wherein the intermediate component includes a top surface having a recess that matingly receives the chambered component.

9. The sole structure of claim 1, wherein the bottom component includes traction elements forming a portion of the ground-contacting surface.

10. A sole structure for an article of footwear having an upper, the sole structure comprising:

a bottom component having a ground-contacting surface; and a chambered component disposed between the bottom component and the upper and including a first portion extending along a medial side of the sole structure, a second portion extending along a lateral side of the sole structure, and a third portion extending from a junction of the first portion and the second portion and including a first segment extending in a first direction along the lateral side of the sole structure and toward a heel region of the sole structure, a second segment extending from the first segment and along the heel region, and a third segment extending from the second segment along the medial side in a second direction opposite the first direction, the third segment defining a terminal end of the third portion that extends toward and is spaced apart from one of the first portion and the second portion.

11. The sole structure of claim 10, wherein the chambered component includes a plurality of chambers defined by walls extending from a first surface of the chambered component.

12. The sole structure of claim 11, wherein the plurality of chambers are disposed between the first surface and the upper.

13. The sole structure of claim 11, wherein the plurality of chambers include a pattern of adjacent polygons.

14. The sole structure of claim 11, wherein the chambered component includes a continuous surface disposed adjacent to the plurality of chambers.

15. The sole structure of claim 14, wherein the continuous surface is disposed in a forefoot region of the sole structure.

16. The sole structure of claim 10, further comprising an intermediate component disposed between the chambered component and the bottom component.

17. The sole structure of claim 16, wherein the intermediate component includes a top surface having a recess that matingly receives the chambered component.

18. The sole structure of claim 10, wherein the bottom component includes traction elements forming a portion of the ground-contacting surface.

* * * * *